US012195158B2

(12) United States Patent
Ernst et al.

(10) Patent No.: US 12,195,158 B2
(45) **Date of Patent: *Jan. 14, 2025**

(54) EXHAUST VENT HOODS FOR MARINE VESSELS AND RELATED METHODS

(71) Applicant: MARATHON PETROLEUM COMPANY LP, Findlay, OH (US)

(72) Inventors: Stephen Daniel Ernst, Findlay, OH (US); James A. Tomlinson, Findlay, OH (US); William Thomas MacKrell, Findlay, OH (US); Mark Howard Nielsen, Findlay, OH (US); Rounack Singh Bumrah, Findlay, OH (US)

(73) Assignee: MARATHON PETROLEUM COMPANY LP, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/648,524

(22) Filed: Apr. 29, 2024

(65) Prior Publication Data

US 2024/0278894 A1 Aug. 22, 2024

Related U.S. Application Data

(63) Continuation of application No. 18/369,514, filed on Sep. 18, 2023, now Pat. No. 12,006,014.

(Continued)

(51) Int. Cl.
*B63H 21/32* (2006.01)
*F01N 3/00* (2006.01)

(52) U.S. Cl.
CPC ..... *B63H 21/32* (2013.01); *F01N 3/00* (2013.01); *F01N 2590/02* (2013.01)

(58) Field of Classification Search
CPC ..... B63H 21/32; F01N 3/00; F01N 2590/02
See application file for complete search history.

(56) References Cited

U.S. PATENT DOCUMENTS 2,626,627 A 1/1953 Jung et al.
2,864,252 A 12/1958 Schaschl (Continued)

FOREIGN PATENT DOCUMENTS

AU 2010241217 11/2010
AU 2013202839 5/2014

(Continued)

OTHER PUBLICATIONS

International Search Report and Written Opinion for international application No. PCT/US2024/021101 mailed on Oct. 9, 2024.

(Continued)

*Primary Examiner* — Stephen P Avila
(74) *Attorney, Agent, or Firm* — Womble Bond Dickinson (US) LLP

(57) ABSTRACT

An embodiment of an exhaust collection system for collecting exhaust from a marine vessel includes an exhaust cleaning assembly including a tank. In addition, the exhaust collection system includes a vent hood in fluid communication with the tank of the exhaust cleaning assembly. The vent hood includes a frame including one or more extendable frame members, and an outer covering that covers the frame to define an enclosure with an opening configured to receive an exhaust stack of the marine vessel therethrough, the one or more extendable frame members to extend and retract to adjust a size of the opening.

20 Claims, 12 Drawing Sheets

Related U.S. Application Data

(60) Provisional application No. 63/521,380, filed on Jun. 16, 2023, provisional application No. 63/485,887, filed on Feb. 18, 2023.

(56) References Cited

U.S. PATENT DOCUMENTS

| | | | |
|---|---|---|---|
| 3,087,311 | A | 4/1963 | Rousseau |
| 3,303,525 | A | 2/1967 | Peoples |
| 3,398,071 | A | 8/1968 | Bagno |
| 3,504,686 | A | 4/1970 | Cooper et al. |
| 3,593,555 | A | 7/1971 | Grosko |
| 3,608,869 | A | 9/1971 | Woodle |
| 3,672,180 | A | 6/1972 | Davis |
| 3,725,669 | A | 4/1973 | Tatum |
| 3,807,433 | A | 4/1974 | Byrd |
| 3,809,113 | A | 5/1974 | Grove |
| 3,814,148 | A | 6/1974 | Wostl |
| 3,925,592 | A | 12/1975 | Webb |
| 3,961,493 | A | 6/1976 | Nolan, Jr |
| 4,010,779 | A | 3/1977 | Pollock et al. |
| 4,073,303 | A | 2/1978 | Foley, Jr. |
| 4,109,677 | A | 8/1978 | Burnside |
| 4,202,351 | A | 5/1980 | Biche |
| 4,229,064 | A | 10/1980 | Vetter et al. |
| 4,242,533 | A | 12/1980 | Cott |
| 4,289,163 | A | 9/1981 | Pierson |
| 4,294,378 | A | 10/1981 | Rabinovich |
| 4,320,775 | A | 3/1982 | Stirling et al. |
| 4,357,576 | A | 11/1982 | Hickam et al. |
| 4,420,008 | A | 12/1983 | Shu |
| 4,457,037 | A | 7/1984 | Rylander |
| 4,481,474 | A | 11/1984 | Gerrit |
| 4,488,570 | A | 12/1984 | Jiskoot |
| 4,630,685 | A | 12/1986 | Huck et al. |
| 4,690,587 | A | 9/1987 | Petter |
| 4,744,305 | A | 5/1988 | Lim et al. |
| 4,788,093 | A | 11/1988 | Murata et al. |
| 4,794,331 | A | 12/1988 | Schweitzer, Jr. |
| 4,848,082 | A | 7/1989 | Takahashi |
| 4,897,226 | A | 1/1990 | Hoyle et al. |
| 4,904,932 | A | 2/1990 | Schweitzer, Jr. |
| 4,964,732 | A | 10/1990 | Cadeo et al. |
| 5,050,064 | A | 9/1991 | Mayhew |
| 5,072,380 | A | 12/1991 | Randelman et al. |
| 5,095,977 | A | 3/1992 | Ford |
| 5,129,432 | A | 7/1992 | Dugger |
| 5,191,537 | A | 3/1993 | Edge |
| 5,305,631 | A | 4/1994 | Whited |
| 5,367,882 | A | 11/1994 | Lievens et al. |
| 5,383,243 | A | 1/1995 | Thacker |
| 5,423,607 | A | 6/1995 | Jones |
| 5,469,830 | A | 11/1995 | Gonzalez |
| 5,516,967 | A | 5/1996 | Pandey |
| 5,533,912 | A | 7/1996 | Fillinger |
| 5,562,133 | A | 10/1996 | Mitchell |
| 5,595,709 | A | 1/1997 | Klemp |
| 5,603,360 | A | 2/1997 | Teel |
| 5,627,749 | A | 5/1997 | Waterman et al. |
| 5,628,351 | A | 5/1997 | Ramsey, Jr. et al. |
| 5,660,602 | A | 8/1997 | Collier, Jr. |
| 5,661,623 | A | 8/1997 | McDonald |
| 5,783,916 | A | 7/1998 | Blackburn |
| 5,814,982 | A | 9/1998 | Thompson et al. |
| 5,832,967 | A | 11/1998 | Andersson |
| 5,873,916 | A | 2/1999 | Cemenska et al. |
| 5,887,974 | A | 3/1999 | Pozniak |
| 5,895,347 | A | 4/1999 | Doyle |
| 5,906,648 | A | 5/1999 | Zoratti et al. |
| 5,906,877 | A | 5/1999 | Popper et al. |
| 5,939,166 | A | 8/1999 | Cheng et al. |
| 5,962,774 | A | 10/1999 | Mowry |
| 5,973,593 | A | 10/1999 | Botella |
| 5,993,054 | A | 11/1999 | Tan et al. |
| 6,022,421 | A | 2/2000 | Bath |
| 6,050,844 | A | 4/2000 | Johnson |
| 6,065,903 | A | 5/2000 | Doyle |
| 6,077,340 | A | 6/2000 | Doyle |
| 6,077,418 | A | 6/2000 | Iseri et al. |
| 6,098,601 | A | 8/2000 | Reddy |
| 6,111,021 | A | 8/2000 | Nakahama et al. |
| 6,149,351 | A | 11/2000 | Doyle |
| 6,186,193 | B1 | 2/2001 | Phallen et al. |
| 6,220,747 | B1 | 4/2001 | Gosselin |
| 6,243,483 | B1 | 6/2001 | Petrou et al. |
| 6,328,877 | B1 | 12/2001 | Bushman |
| 6,333,374 | B1 | 12/2001 | Chen |
| 6,346,813 | B1 | 2/2002 | Kleinberg |
| 6,383,237 | B1 | 5/2002 | Langer et al. |
| 6,427,384 | B1 | 8/2002 | Davis, Jr. |
| 6,478,353 | B1 | 11/2002 | Barrozo |
| 6,679,302 | B1 | 1/2004 | Mattingly et al. |
| 6,719,921 | B2 | 4/2004 | Steinberger et al. |
| 6,799,883 | B1 | 10/2004 | Urquhart et al. |
| 6,834,531 | B2 | 12/2004 | Rust |
| 6,840,292 | B2 | 1/2005 | Hart et al. |
| 6,851,916 | B2 | 2/2005 | Schmidt |
| 6,980,647 | B1 | 12/2005 | Daugherty et al. |
| 6,987,877 | B2 | 1/2006 | Paz-Pujalt et al. |
| 7,032,629 | B1 | 4/2006 | Mattingly et al. |
| 7,091,421 | B2 | 8/2006 | Kukita et al. |
| 7,168,464 | B2 | 1/2007 | Diggins |
| 7,186,321 | B2 | 3/2007 | Benham |
| 7,258,710 | B2 | 8/2007 | Caro et al. |
| 7,275,366 | B2 | 10/2007 | Powell et al. |
| 7,294,913 | B2 | 11/2007 | Fischer et al. |
| 7,385,681 | B2 | 6/2008 | Ninomiya et al. |
| 7,444,996 | B2 | 11/2008 | Potier |
| 7,459,067 | B2 | 12/2008 | Dunn et al. |
| 7,564,540 | B2 | 7/2009 | Paulson |
| 7,631,671 | B2 | 12/2009 | Mattingly et al. |
| 7,729,561 | B1 | 6/2010 | Boland et al. |
| 7,749,308 | B2 | 7/2010 | McCully |
| 7,810,988 | B2 | 10/2010 | Kamimura et al. |
| 7,815,744 | B2 | 10/2010 | Abney et al. |
| 7,832,338 | B2 | 11/2010 | Caro et al. |
| 7,879,204 | B2 | 2/2011 | Funahashi |
| 8,075,651 | B2 | 12/2011 | Caro et al. |
| 8,282,265 | B2 | 10/2012 | Breithhaupt |
| 8,299,811 | B2 | 10/2012 | Wing |
| 8,312,584 | B2 | 11/2012 | Hodde |
| 8,327,631 | B2 | 12/2012 | Caro et al. |
| 8,368,405 | B2 | 2/2013 | Siebens |
| 8,376,432 | B1 | 2/2013 | Halger et al. |
| 8,402,746 | B2 | 3/2013 | Powell et al. |
| 8,413,484 | B2 | 4/2013 | Lubkowitz |
| 8,414,781 | B2 | 4/2013 | Berard |
| 8,577,518 | B2 | 11/2013 | Linden et al. |
| 8,597,380 | B2 | 12/2013 | Buchanan |
| 8,616,760 | B2 | 12/2013 | Williams et al. |
| 8,632,359 | B2 | 1/2014 | Grimm |
| 8,647,162 | B2 | 2/2014 | Henriksson et al. |
| 8,748,677 | B2 | 6/2014 | Buchanan |
| 8,808,415 | B2 | 8/2014 | Caro et al. |
| 8,912,924 | B2 | 12/2014 | Scofield et al. |
| 8,979,982 | B2 | 3/2015 | Jordan et al. |
| 9,038,855 | B2 | 5/2015 | Lurcott et al. |
| 9,162,944 | B2 | 10/2015 | Bennett et al. |
| 9,175,235 | B2 | 11/2015 | Kastner |
| 9,222,480 | B2 | 12/2015 | Younes et al. |
| 9,310,016 | B2 | 4/2016 | Hodde |
| 9,329,066 | B2 | 5/2016 | Skarping |
| 9,363,462 | B2 | 6/2016 | Yoel |
| 9,388,350 | B2 | 7/2016 | Buchanan |
| 9,518,693 | B2 | 12/2016 | Hodde |
| 9,530,121 | B2 | 12/2016 | Brauer et al. |
| 9,550,247 | B2 | 1/2017 | Smith |
| 9,643,135 | B1 | 5/2017 | Mazzei et al. |
| 9,945,333 | B2 | 4/2018 | Kopinsky |
| 10,001,240 | B1 | 6/2018 | Dray et al. |
| 10,012,340 | B1 | 7/2018 | Dray et al. |
| 10,024,768 | B1 | 7/2018 | Johnsen |
| 10,094,508 | B1 | 10/2018 | Dray et al. |
| 10,134,042 | B1 | 11/2018 | Prasad et al. |

(56) References Cited

U.S. PATENT DOCUMENTS 10,168,255 B1 1/2019 Johnsen
10,196,243 B1 2/2019 Wells
10,197,206 B1 2/2019 Dray et al.
10,223,596 B1 3/2019 Edwards et al.
10,247,643 B1 4/2019 Johnsen
10,261,279 B1 4/2019 Potter
10,287,940 B2 5/2019 Tonsich
10,345,221 B1 7/2019 Silverman
10,364,718 B2 7/2019 Eddaoudi et al.
10,386,260 B2 8/2019 Dudek
10,408,377 B1 9/2019 Dray et al.
10,486,946 B1 11/2019 Wells
10,501,385 B1 12/2019 Buckner et al.
10,563,555 B2 2/2020 Hamad
10,570,581 B2 2/2020 Faivre
10,605,144 B2 3/2020 Kobayashi
10,633,830 B2 4/2020 Shibamori
10,655,774 B1 5/2020 Dray et al.
10,657,443 B2 5/2020 Araujo et al.
10,688,686 B2 6/2020 Fadhel et al.
10,756,459 B2 8/2020 Jongsma
10,833,434 B1 11/2020 Tassell, Jr.
10,943,357 B2 3/2021 Badawy et al.
10,948,471 B1 3/2021 MacMullin et al.
10,953,960 B1 3/2021 Sharp
10,962,437 B1 3/2021 Nottrott et al.
10,970,927 B2 4/2021 Sharp
10,990,114 B1 4/2021 Miller
10,997,707 B1 5/2021 Katz et al.
11,010,608 B2 5/2021 Adam et al.
11,027,304 B2 6/2021 Donaldson
11,112,308 B2 9/2021 Kreitinger et al.
11,125,391 B2 9/2021 Al Khowaiter et al.
11,132,008 B2 9/2021 Miller
11,164,406 B2 11/2021 Meroux et al.
11,221,107 B2 1/2022 Du et al.
11,247,184 B2 2/2022 Miller
11,325,687 B1 5/2022 Sharp
11,332,070 B2 5/2022 Holden et al.
11,345,455 B2 5/2022 Sharp
11,416,012 B2 8/2022 Miller
11,428,600 B2 8/2022 Dankers et al.
11,428,622 B2 8/2022 Borin et al.
11,441,088 B2 9/2022 Robbins
11,447,877 B1 9/2022 Ell
11,559,774 B2 1/2023 Miller
11,565,221 B2 1/2023 Miller
11,578,638 B2 2/2023 Thobe
11,578,836 B2 2/2023 Thobe
11,596,910 B2 3/2023 Miller
11,607,654 B2 3/2023 Miller
11,655,748 B1 5/2023 Thobe
11,655,940 B2 5/2023 Thobe
11,662,750 B2 5/2023 Miller
11,686,070 B1 6/2023 Jordan et al.
11,715,950 B2 8/2023 Miller et al.
11,720,526 B2 8/2023 Miller et al.
11,739,679 B2 8/2023 Thobe
11,752,472 B2 9/2023 Miller
11,754,225 B2 9/2023 Thobe
11,761,366 B2 9/2023 Thobe
11,774,042 B2 10/2023 Thobe
11,794,153 B2 10/2023 Miller
11,807,945 B2 11/2023 Ell
11,808,013 B1 11/2023 Jordan et al.
11,815,227 B2 11/2023 Thobe
11,920,504 B2 3/2024 Thobe
11,965,317 B2 4/2024 Jordan
11,988,336 B2 5/2024 Thobe
12,000,538 B2 6/2024 Thobe
12,006,014 B1 * 6/2024 Ernst ..... F01N 3/00
12,011,697 B2 6/2024 Miller
12,012,082 B1 6/2024 Pittman, Jr.
12,012,883 B2 6/2024 Thobe
12,043,361 B1 * 7/2024 Ernst ..... B63H 21/32
12,043,905 B2 7/2024 Ell
12,043,906 B2 7/2024 Ell
12,066,843 B2 8/2024 Miller
12,087,002 B1 9/2024 Miller et al.
12,109,543 B2 10/2024 Miller
12,128,369 B2 10/2024 Miller
12,129,559 B2 10/2024 Ell
2002/0014068 A1 2/2002 Mittricker et al.
2002/0178806 A1 12/2002 Valentine
2003/0041518 A1 3/2003 Wallace et al.
2003/0121481 A1 7/2003 Dodd et al.
2003/0158630 A1 8/2003 Pham et al.
2003/0167660 A1 9/2003 Kondou
2003/0178994 A1 9/2003 Hurlimann et al.
2003/0188536 A1 10/2003 Mittricker
2003/0197622 A1 10/2003 Reynard et al.
2003/0227821 A1 12/2003 Bae et al.
2004/0057334 A1 3/2004 Wilmer et al.
2004/0058597 A1 3/2004 Matsuda
2004/0067126 A1 4/2004 Schmidt
2004/0125688 A1 7/2004 Kelley et al.
2004/0249105 A1 12/2004 Nolte et al.
2004/0265653 A1 12/2004 Buechi et al.
2005/0007450 A1 1/2005 Hill et al.
2005/0058016 A1 3/2005 Smith et al.
2005/0146437 A1 7/2005 Ward
2005/0150820 A1 7/2005 Guo
2005/0154132 A1 7/2005 Hakuta et al.
2005/0176482 A1 8/2005 Raisinghani et al.
2005/0284333 A1 12/2005 Falkiewicz
2006/0125826 A1 6/2006 Lubkowitz
2006/0263283 A1 11/2006 Egan
2006/0278304 A1 12/2006 Mattingly et al.
2007/0175511 A1 8/2007 Doerr
2007/0181083 A1 8/2007 Fulton
2008/0092625 A1 4/2008 Hinnrichs
2008/0113884 A1 5/2008 Campbell et al.
2008/0115834 A1 5/2008 Geoffrion et al.
2008/0149481 A1 6/2008 Hurt
2008/0283083 A1 11/2008 Piao
2009/0009308 A1 1/2009 Date et al.
2009/0107111 A1 4/2009 Oliver
2009/0154288 A1 6/2009 Heathman
2009/0175738 A1 7/2009 Shaimi
2009/0183498 A1 7/2009 Uchida et al.
2009/0188565 A1 7/2009 Satake
2009/0197489 A1 8/2009 Caro
2010/0031825 A1 2/2010 Kemp
2010/0049410 A1 2/2010 McKee
2010/0058666 A1 3/2010 Kim
2010/0198775 A1 8/2010 Rousselle
2011/0265449 A1 11/2011 Powell
2012/0027298 A1 2/2012 Dow
2012/0092835 A1 4/2012 Miller
2012/0143560 A1 6/2012 Tabet et al.
2012/0185220 A1 7/2012 Shippen
2012/0276379 A1 11/2012 Daniels et al.
2012/0304625 A1 12/2012 Daikoku
2013/0035824 A1 2/2013 Nakamura
2013/0048094 A1 2/2013 Ballantyne
2013/0062258 A1 3/2013 Ophus
2013/0125323 A1 5/2013 Henderson
2013/0176656 A1 7/2013 Kaisser
2013/0186671 A1 7/2013 Theis
2013/0201025 A1 8/2013 Kamalakannan et al.
2013/0245524 A1 9/2013 Schofield
2013/0293884 A1 11/2013 Lee et al.
2013/0299500 A1 11/2013 McKinnon
2013/0317959 A1 11/2013 Joos
2014/0002639 A1 1/2014 Cheben et al.
2014/0008926 A1 1/2014 Allen
2014/0062490 A1 3/2014 Neuman et al.
2014/0090379 A1 4/2014 Powell et al.
2014/0121622 A1 5/2014 Jackson et al.
2014/0133824 A1 5/2014 Yoel
2014/0158616 A1 6/2014 Govind et al.
2014/0158632 A1 6/2014 Govind et al.
2014/0171538 A1 6/2014 Daniels et al.
2014/0176344 A1 6/2014 Littlestar

(56) References Cited

U.S. PATENT DOCUMENTS

2014/0190691 A1 7/2014 Vinegar
2014/0194657 A1 7/2014 Wadhwa et al.
2014/0299039 A1 10/2014 Trollux
2014/0345370 A1 11/2014 Marotta
2014/0356707 A1 12/2014 Kwon et al.
2015/0081165 A1 3/2015 Yamashita et al.
2015/0144468 A1 5/2015 Skolozdra
2015/0183102 A1 7/2015 Breschi et al.
2015/0198518 A1 7/2015 Borin et al.
2015/0244087 A1 8/2015 Wing
2015/0269288 A1 9/2015 Moore
2015/0323119 A1 11/2015 Giunta
2016/0071059 A1 3/2016 Petering
2016/0091467 A1 3/2016 Morris
2016/0139355 A1 5/2016 Petersen
2016/0169098 A1 6/2016 Makita
2016/0169436 A1 6/2016 Sander et al.
2016/0175634 A1 6/2016 Radian
2016/0238194 A1 8/2016 Adler et al.
2016/0252650 A1 9/2016 Hirst, Sr.
2016/0363249 A1 12/2016 Disher
2016/0369930 A1 12/2016 Poe et al.
2017/0051472 A1 2/2017 Mochimaru
2017/0088401 A1 3/2017 Clements et al.
2017/0122174 A1 5/2017 Patel
2017/0131728 A1 5/2017 Lambert et al.
2017/0140237 A1 5/2017 Voeller et al.
2017/0158303 A1 6/2017 Michaelis et al.
2017/0180012 A1 6/2017 Tingler et al.
2017/0248569 A1 8/2017 Lambert et al.
2017/0253737 A1 9/2017 Auld et al.
2017/0253738 A1 9/2017 Auld et al.
2017/0253806 A1 9/2017 Auld et al.
2017/0254481 A1 9/2017 Cadogan et al.
2017/0259229 A1 9/2017 Chou et al.
2017/0306428 A1 10/2017 Helgason et al.
2017/0326474 A1 11/2017 Olovsson
2017/0367346 A1 12/2017 Rees et al.
2018/0002617 A1 1/2018 Umansky et al.
2018/0003116 A1 1/2018 Fersman et al.
2018/0037452 A1 2/2018 Gray et al.
2018/0080356 A1 3/2018 Fukui
2018/0098137 A1 4/2018 Saha
2018/0119882 A1 5/2018 Allidieres et al.
2018/0143734 A1 5/2018 Ochenas et al.
2018/0186528 A1 7/2018 Tonn
2018/0218214 A1 8/2018 Pestun
2018/0223202 A1 8/2018 Fransham et al.
2018/0245313 A1 8/2018 Shibamori et al.
2018/0259064 A1 9/2018 McLemore
2018/0312391 A1 11/2018 Borg
2019/0016963 A1 1/2019 Auld et al.
2019/0121373 A1 4/2019 Panigrahi
2019/0367732 A1 5/2019 Helgason et al.
2019/0270500 A1 9/2019 Hamaoka
2019/0295189 A1 9/2019 Strasser
2019/0338203 A1 11/2019 Umansky et al.
2019/0359899 A1 11/2019 Umansky et al.
2019/0362147 A1 11/2019 Adam
2019/0136060 A1 12/2019 Helgason et al.
2019/0368054 A1 12/2019 Gummow et al.
2019/0368156 A1 12/2019 Faivre
2020/0033252 A1 1/2020 Borin et al.
2020/0118413 A1 4/2020 Kanukurthy et al.
2020/0232191 A1 7/2020 Prior
2020/0240588 A1 7/2020 Al Khowaiter
2020/0245551 A1 8/2020 Hoffman et al.
2020/0245552 A1 8/2020 Hoffman et al.
2020/0245553 A1 8/2020 Hoffman et al.
2020/0292445 A1 9/2020 Morimoto
2020/0325742 A1 10/2020 Astudillo et al.
2021/0053011 A1 2/2021 Sugiyama et al.
2021/0062697 A1 3/2021 Yokoyama et al.
2021/0073692 A1 3/2021 Saha et al.
2021/0076006 A1 3/2021 O'Neill et al.
2021/0095380 A1 4/2021 Borin et al.
2021/0123211 A1 4/2021 Miller et al.
2021/0138399 A1 5/2021 Yokoyama et al.
2021/0192938 A1 6/2021 Doerr et al.
2021/0197151 A1 7/2021 Miller
2021/0207772 A1 7/2021 Norton et al.
2021/0215925 A1 7/2021 Kim et al.
2021/0216852 A1 7/2021 Reece et al.
2021/0232163 A1 7/2021 Miller
2021/0232741 A1 7/2021 Ogiso et al.
2021/0362637 A1 11/2021 Hanis et al.
2021/0381920 A1 12/2021 Jacobsz et al.
2022/0001969 A1 1/2022 Pugnetti
2022/0010707 A1 1/2022 Sharma et al.
2022/0048606 A1 2/2022 Singh
2022/0081261 A1 3/2022 Karbassi
2022/0087099 A1 3/2022 Hoffman et al.
2022/0154427 A1 5/2022 Misaki
2022/0178114 A1 6/2022 Takahama
2022/0186470 A1 6/2022 Chiba et al.
2022/0213603 A1 7/2022 Al Eid et al.
2022/0221368 A1 7/2022 Bergeron
2022/0228345 A1 7/2022 Case et al.
2022/0282651 A1 9/2022 Reynolds et al.
2022/0290411 A1 9/2022 Anahara et al.
2022/0343229 A1 10/2022 Gruber et al.
2022/0401899 A1 12/2022 Miller
2022/0404272 A1 12/2022 Kendall et al.
2023/0012673 A1 1/2023 Fukuyama et al.
2023/0015077 A1 1/2023 Kim
2023/0061824 A1 3/2023 Ell
2023/0078852 A1 3/2023 Campbell et al.
2023/0129513 A1 4/2023 Miller
2023/0259080 A1 8/2023 Whikehart et al.
2023/0259088 A1 8/2023 Borup et al.
2023/0332532 A1 10/2023 Thobe
2023/0333577 A1 10/2023 Miller
2023/0333578 A1 10/2023 Miller
2023/0341092 A1 10/2023 Thobe
2023/0347303 A1 11/2023 Miller
2023/0358023 A1 11/2023 Jordan et al.
2023/0366510 A1 11/2023 Thobe
2023/0383416 A1 11/2023 Ell
2023/0383417 A1 11/2023 Ell
2023/0383418 A1 11/2023 Ell
2023/0392536 A1 12/2023 Thobe
2023/0399817 A1 12/2023 Jordan
2023/0399818 A1 12/2023 Jordan
2023/0407488 A1 12/2023 Ell
2023/0415106 A1 12/2023 Miller
2024/0003016 A1 1/2024 Ell
2024/0060189 A1 2/2024 Ell
2024/0141506 A1 5/2024 Ell
2024/0166492 A1 5/2024 Thobe
2024/0209988 A1 6/2024 Thobe
2024/0217498 A1 7/2024 Pittman, Jr.
2024/0255102 A1 8/2024 Thobe
2024/0269626 A1 8/2024 Miller
2024/0271556 A1 8/2024 Thobe
2024/0278762 A1 8/2024 Pittman, Jr.
2024/0286726 A1 8/2024 Ernst
2024/0301811 A1 9/2024 Thobe
2024/0327992 A1 10/2024 Ell
2024/0327993 A1 10/2024 Ell

FOREIGN PATENT DOCUMENTS

CA 2447358 4/2005
CA 2702151 10/2007
CA 2637421 1/2010
CA 2642295 1/2010
CA 2736733 10/2011
CA 2958443 4/2017
CA 2995532 4/2017
CA 2916141 6/2017
CN 2092562 1/1992
CN 200958686 10/2007
CN 100348970 11/2007
CN 102997052 3/2013

(56) References Cited

FOREIGN PATENT DOCUMENTS

| | | | |
|---|---|---|---|
| CN | 202898548 | U | 4/2013 |
| CN | 103106764 | | 5/2013 |
| CN | 103497804 | | 1/2014 |
| CN | 102997061 | | 5/2015 |
| CN | 204824775 | | 12/2015 |
| CN | 205640252 | | 10/2016 |
| CN | 104372350 | B | 2/2017 |
| CN | 106764463 | | 1/2019 |
| CN | 208306600 | | 1/2019 |
| CN | 110513604 | | 11/2019 |
| CN | 210176958 | | 3/2020 |
| CN | 111537157 | | 8/2020 |
| CN | 114001278 | | 2/2022 |
| CN | 113719746 | | 11/2022 |
| CN | 115325460 | A | 11/2022 |
| CN | 114877263 | | 4/2023 |
| EP | 2458573 | | 5/2012 |
| EP | 2602609 | | 6/2013 |
| EP | 3076461 | | 10/2016 |
| EP | 3101411 | | 12/2016 |
| EP | 3112011 | | 1/2017 |
| EP | 2994626 | | 1/2018 |
| EP | 3285759 | | 2/2018 |
| ES | 2398302 | | 3/2013 |
| FR | 2388762 | | 11/1978 |
| FR | 2689241 | | 10/1993 |
| GB | 1179978 | | 2/1970 |
| GB | 2097687 | | 11/1982 |
| GB | 2545207 | | 6/2017 |
| GB | 2559149 | | 4/2022 |
| IN | 202141001384 | | 1/2021 |
| IT | 201900008235 | | 12/2020 |
| JP | 2004125039 | | 4/2004 |
| JP | 2007204023 | | 8/2007 |
| JP | 2008097832 | | 4/2008 |
| JP | 2012002159 | | 11/2014 |
| JP | 2016078893 | | 5/2016 |
| KR | 20110010316 | | 2/2011 |
| KR | 20130038986 | | 4/2013 |
| KR | 20200007444 | A | 1/2020 |
| KR | 102129951 | | 7/2020 |
| KR | 102169280 | | 10/2020 |
| KR | 102281640 | | 7/2021 |
| RU | 2760879 | | 12/2021 |
| WO | 1996006685 | | 5/1996 |
| WO | 1997006004 | | 2/1997 |
| WO | 1997006298 | | 2/1997 |
| WO | 1998003711 | | 1/1998 |
| WO | 2000063108 | | 10/2000 |
| WO | 2002030551 | | 4/2002 |
| WO | 2003003002 | | 1/2003 |
| WO | 2003066423 | | 8/2003 |
| WO | 2004003293 | | 1/2004 |
| WO | 2004092307 | | 10/2004 |
| WO | 2005018300 | | 3/2005 |
| WO | 2007107652 | | 9/2007 |
| WO | 2007112335 | | 10/2007 |
| WO | 2007149851 | | 12/2007 |
| WO | 2009013544 | | 1/2009 |
| WO | 2009055024 | | 4/2009 |
| WO | 2010042704 | | 4/2010 |
| WO | 2010103260 | | 9/2010 |
| WO | 2011127535 | | 10/2011 |
| WO | 2013112274 | | 8/2013 |
| WO | 2014089443 | | 6/2014 |
| WO | 2014173672 | | 10/2014 |
| WO | 2015061868 | | 5/2015 |
| WO | 2015153607 | | 10/2015 |
| WO | 2016004107 | | 1/2016 |
| WO | 2016026043 | | 2/2016 |
| WO | 2016146404 | | 9/2016 |
| WO | 2017074985 | | 5/2017 |
| WO | 2017083778 | | 5/2017 |
| WO | 2017087731 | | 5/2017 |
| WO | 2017152269 | | 9/2017 |
| WO | 2018005141 | | 1/2018 |
| WO | 2018102378 | | 6/2018 |
| WO | 2020044026 | | 3/2020 |
| WO | 2020118020 | | 6/2020 |
| WO | 2020132632 | | 6/2020 |
| WO | 2020223803 | | 11/2020 |
| WO | 2020237112 | | 11/2020 |
| WO | 2021062563 | | 4/2021 |
| WO | 2021100054 | | 5/2021 |
| WO | 2022043197 | | 3/2022 |
| WO | 2022126092 | | 6/2022 |
| WO | 2022149501 | | 7/2022 |
| WO | 2023287276 | | 1/2023 |
| WO | 2023038579 | | 3/2023 |
| WO | 2023137304 | | 7/2023 |
| WO | 2023164683 | | 8/2023 |
| ZA | 9606765 | | 2/1998 |
| ZA | 200610366 | | 1/2008 |

OTHER PUBLICATIONS

Neutrik XXR-2 XX Series, https://www.parts-express.com/Neutrik-XXR-2-XX-Series-Color-Coding_Ring-Red, 2022.

Hou, Qingmin, An FBG Strain Sensor-Based NPW Method for Natural Gas Pipeline Leakage Detection, Hindawi, Mathematical Problems in Engineering, vol. 2021, Article ID 5548503, pp. 1-8.

International Search Report and Written Opinion for international application No. PCT/US2024/021099 mailed on Aug. 2, 2024.

Annex to Form PCT/ISA/206, Communication Relating to the Results of the Partial International Search for international application No. PCT/US2024/021101 mailed Aug. 13, 2024.

Sadovnychiy, Sergiy et al. "Geographical information system applications for pipeline right of way aerial surveillance", International Conference on Geographical Information Systems Theory, Applications and Management, vol. 2, SCITEPRESS, 2017.

Paschal, Kayla, "Utility Right of Way Management: Potential for Expanded Integrated Vegetation Management in California", 2014.

Skelton et al., Onboard Refueling Vapor Recovery Systems Analysis of Widespread Use, Nescaum, Boston MA, Aug. 20, 2007.

Membrane Technology and Research, Inc., Gasoline Vapor Recovery, 2018.

Jordan Technologies, Aereon, Recovering More Vapor = Increased Profits, 2015.

EPFL, Capturing CO2 from trucks and reducing their emissions by 90%, Dec. 23, 2019.

Sharma, Shivom et al., Carbon Dioxide Capture from Internal Combustion Engine Exhaust Using Temperature Swing Adsorption, Front. Energy Res., Sec. Carbon Capture, Utilization and Storage, Dec. 16, 2019.

Information Disclosure Declaration by Kyle E. Miller, Dec. 18, 2020.

Cott Manufacturing Company, FinkLet®/FinkPlate® Cathodic Proection Test Stations, Wayback Machine, May 22, 2000.

Alexandrakis et al.,"Marine Transportation for Carbon Capture and Sequestration (CCS)", Department of Civil and Environmental Engineering, Thesis, Massachusetts Institute of Technology, Jun. 2010.

Datta et al., "Advancing carbon management through the global commoditization of CO2: the case for dual-use LNG-CO2 shipping", Carbon Management, 2020, vol. 11, No. 6, 611-630.

Ibitoye et al., "Poster Abstract: A Convolutional Neural Network Based Solution for Pipeline Leak Detection", School of Information Technology, Carleton University, Ottawa, Canada, Nov. 2019.

Intelliview, "Thermal Imaging Provides Early Leak Detection in Oil and Gas Pipelines", Petro Industry News, www.Petro-Online.com, Aug./Sep. 2018.

Southwest Research Institute, "Methane Leak Detection", 2021.

Lloyd's Register, Using technology to trace the carbon intensity of sustainable marine fuels, Feb. 15, 2023.

Borin Manufacturing, Inc., DART for Test Station, Above Ground Remote Monitoring, Feb. 11, 2021.

Borin Manufacturing, Inc., COMMANCHE Remote Monitoring and Control System, Mar. 24, 2017.

(56) References Cited

OTHER PUBLICATIONS

Borin Manufacturing, Inc., DART for Rectifiers, Remote Monitoring and Control System. Nov. 1, 2017.
Borin Manufacturing, Inc., STELTH 2 Solid-State Reference Electrode for Buried and Concrete Service, Aug. 7, 2015.
Borin Manufacturing, Inc., STELTH 3, Nov. 10, 2016.
Borin Manufacturing, Inc., STELTH Reference Electrodes, Feb. 4, 2016.
Borin Manufacturing, Inc., STELTH Solid-State Reference Electrodes, Nov. 8, 2016.
Borin Manufacturing, Inc., STELTH Reference Electrodes, Oct. 10, 2017.
Borin Manufacturing, Inc., 'Miracle half-cell', Palladium: BORIN's new reference electrode chemistry, Aug. 13, 2014.
Borin Manufacturing, Inc., Street Dart, For Test Station, Ground Level Remote Monitoring, Mar. 2017.

* cited by examiner

EXHAUST VENT HOODS FOR MARINE VESSELS AND RELATED METHODS

CROSS-REFERENCE TO RELATED APPLICATIONS

This application is a continuation of U.S. Non-Provisional application Ser. No. 18/369,514, filed Sep. 18, 2023, titled "EXHAUST VENT HOODS FOR MARINE VESSELS AND RELATED METHODS," which claims priority to and the benefit of U.S. Provisional Application No. 63/485,887, filed Feb. 18, 2023, and entitled "Exhaust Vent Hoods for Marine Vessels and Related Methods," and U.S. provisional application Ser. No. 63/521,380, filed Jun. 16, 2023, and entitled "Exhaust Vent Hoods for Marine Vessels and Related Methods," the contents of which are incorporated herein by reference in their entirety.

BACKGROUND

This disclosure generally relates to marine vessels that are configured to travel on navigable bodies of water. More particularly, this disclosure relates to vent hoods for collecting exhaust from a marine vessel and related methods.

A marine vessel may include any suitable vessel or boat that is transportable or movable across a body of water (such as an ocean, lake, river, etc.). Such marine vessels may include engines, motors, generators, and other systems configured to output exhaust fluids (or more simply "exhaust"). Typically, the exhaust is emitted to the atmosphere during operations. However, when multiple marine vessels are concentrated in the same geographical area, the combined exhaust from the marine vessels may significantly degrade the local air quality. Berthing locations such as ports, piers, harbors, moorings, etc., may represent locations where large numbers of marine vessels congregate. Thus, in a number of jurisdictions, rules or regulations regarding the output of exhaust at berthing locations have been or will be implemented to preserve the air quality both within the berthing location and in neighboring areas.

BRIEF SUMMARY

Some embodiments disclosed herein include vent hoods that may collect exhaust emitted from a marine vessel when the marine vessel is positioned at a berthing location. In some embodiments, the collected exhaust may be routed to an exhaust cleaning assembly that may store and/or process the exhaust to prevent harmful chemicals or pollutants within the exhaust from being emitted to the atmosphere. In some embodiments, the vent hoods of the embodiments disclosed herein may be adjustable to engage with exhaust stacks of multiple sizes and/or shapes. Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

Some embodiments disclosed herein are directed to a vent hood for collecting exhaust from a marine vessel. In some embodiments, the vent hood includes a housing further including: an upper end, a lower end spaced from the upper end along a central axis of the housing, and an opening positioned at the lower end configured to receive an exhaust stack of the marine vessel therethrough. In addition, the vent hood includes an engagement adjustment assembly connected to the housing that is configured to increase a length of the housing between the upper end and the lower end to thereby increase a size of the opening.

Some embodiments disclosed herein are directed to an exhaust collection system for collecting exhaust from a marine vessel. In some embodiments, the exhaust collection includes an exhaust cleaning assembly including a tank, and a vent hood in fluid communication with the tank of the exhaust cleaning assembly. The vent hood includes a frame including one or more extendable frame members. In addition, the vent hood includes an outer covering that covers the frame to define an enclosure with an opening configured to receive an exhaust stack of the marine vessel therethrough, the one or more extendable frame members to extend and retract to adjust a size of the opening.

Some embodiments disclosed herein are directed to a vent hood for collecting exhaust from a marine vessel. In some embodiments, the vent hood includes a housing defining an enclosure, the housing including an opening into the enclosure. In addition, the vent hood includes an engagement adjustment assembly configured to adjust a size of the opening. Further, the vent hood includes a seal configured to engage with an outer surface of an exhaust stack of the marine vessel when the housing is lowered onto the exhaust stack, the seal being positioned at least partially within the enclosure and connected to the engagement adjustment assembly such that the seal surrounds the opening and expands and contracts as the engagement adjustment assembly adjusts the size of the opening.

Some embodiments disclosed herein are directed to a method of collecting exhaust from a marine vessel. In some embodiments, the method includes (a) lowering a vent hood over an exhaust stack of the marine vessel, the vent hood including a housing having an upper end, a lower end spaced from the upper end along a central axis, and an opening positioned at the lower end. In addition, the method includes (b) adjusting a length of the housing along the central axis to thereby adjust a size of the opening. Further, the method includes (c) receiving the exhaust stack at least partially within the housing via the opening. Still further, the method includes (d) receiving the exhaust emitted from the exhaust stack into the housing.

In some embodiments, the method includes (a) lowering a vent hood over an exhaust stack of the marine vessel, the vent hood including a housing having a frame and an outer cover that covers the frame to define an enclosure, the frame including one or more extendable frame members, and the enclosure having an opening. In addition, the method includes (b) adjusting a length of the one or more extendable frame members to adjust a size of the opening. Further, the method includes (c) inserting the exhaust stack into the opening. Still further, the method includes (d) receiving the exhaust emitted from the exhaust stack into the enclosure.

In some embodiments, the method includes (a) lowering a vent hood over an exhaust stack of the marine vessel, the vent hood including: a housing defining an enclosure and having an opening into the enclosure, an engagement adjustment assembly, and a seal positioned at least partially within the enclosure. In addition, the method includes (b) expanding or contracting a size of the opening with the engagement adjustment assembly. Further, the method includes (c) expanding or contracting the seal with the opening during (b). Still further, the method includes (d) engaging the seal with an outer surface of the exhaust stack to prevent exhaust from flowing out of the enclosure via the opening.

Embodiments described herein include a combination of features and characteristics intended to address various shortcomings associated with certain prior devices, systems, and methods. The foregoing has outlined rather broadly the features and technical characteristics of some of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, the exhaust from marine vessels at a berthing location may degrade air quality and may even be restricted by local rules and regulations. However, ceasing operation of all exhaust-emitting systems on a marine vessel may not be desirable or feasible while the marine vessel is at the berthing location. For instance, electrical generation systems (for example diesel generators, turbine generators, etc.) may continue to operate so that other electrically operated systems and assemblies of the marine vessel (for example communications systems, safety systems, control systems, water and sewage systems, HVAC systems, etc.) may also be operated while at the berthing location. In addition, some berthing locations do not have sufficient infrastructure to support and operate these various systems and assemblies of the berthed marine vessels independently of the exhaust-emitting systems of the marine vessels.

Accordingly, embodiments disclosed herein include vent hoods that may collect exhaust emitted from a marine vessel when the marine vessel is positioned at a berthing location. In some embodiments, the collected exhaust may be routed to an exhaust cleaning assembly that may store and/or process the exhaust to prevent harmful chemicals or pollutants within the exhaust from being emitted to the atmosphere. In some embodiments, the vent hoods of the embodiments disclosed herein may be adjustable to engage with exhaust stacks of multiple sizes and/or shapes. Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

Figure 1:
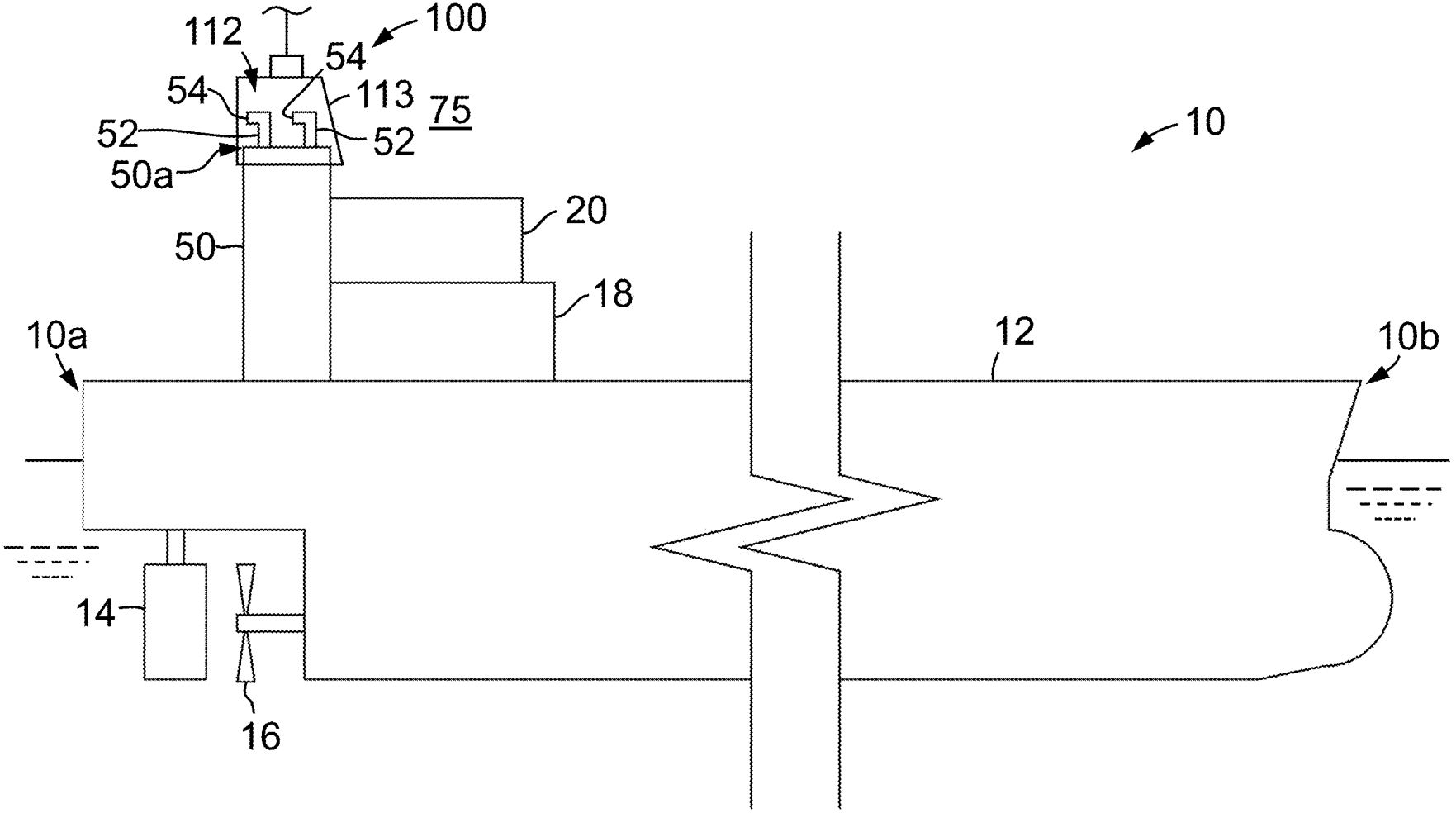
FIG. 1 is a schematic side view of a marine vessel and a vent hood according to some embodiments of the disclosure.

FIG. 1 shows a vent hood 100 for collecting exhaust emitted from a marine vessel 10 according to some embodiments. The marine vessel 10 may include any suitable vessel or ship that may travel within or across a navigable body of water such as, for instance, an ocean, a sea, a lake, a river, a channel, etc. In some embodiments, the marine vessel 10 may be a cargo vessel, such as a container ship, tankship, reefer ship, etc.

Marine vessel 10 includes a rear end (or stern) 10*a*, a front end (or bow) 10*b* opposite rear end 10*a*, and a main deck (or more simply "deck") 12 extending between ends 10*a*, 10*b*. Deck 12 may define an exterior surface (or collection of exterior surfaces) on the marine vessel 10 that may be accessed by personnel.

A rutter 14 and propeller 16 may be positioned at (or proximate to) rear end 10*a*. As is known to one having ordinary skill in the art, the propeller 16 may provide propulsion to the marine vessel 10, and the rutter 14 may be turned to steer the marine vessel 10 within a body of water.

An accommodation deck (or more simply "accommodation") 18 is positioned atop deck 12. The accommodation 18 is the living space of the marine vessel 10 and may include one or more cabins (or rooms), galleys, store rooms, messrooms, or other rooms that may be used by personnel. A bridge 20 may be positioned atop (or adjacent to) the accommodation 18. The bridge 20 may include one or more controls for the marine vessel 10 including (for instance) steering controls, communications systems, other system controls, etc.

Figure 2:
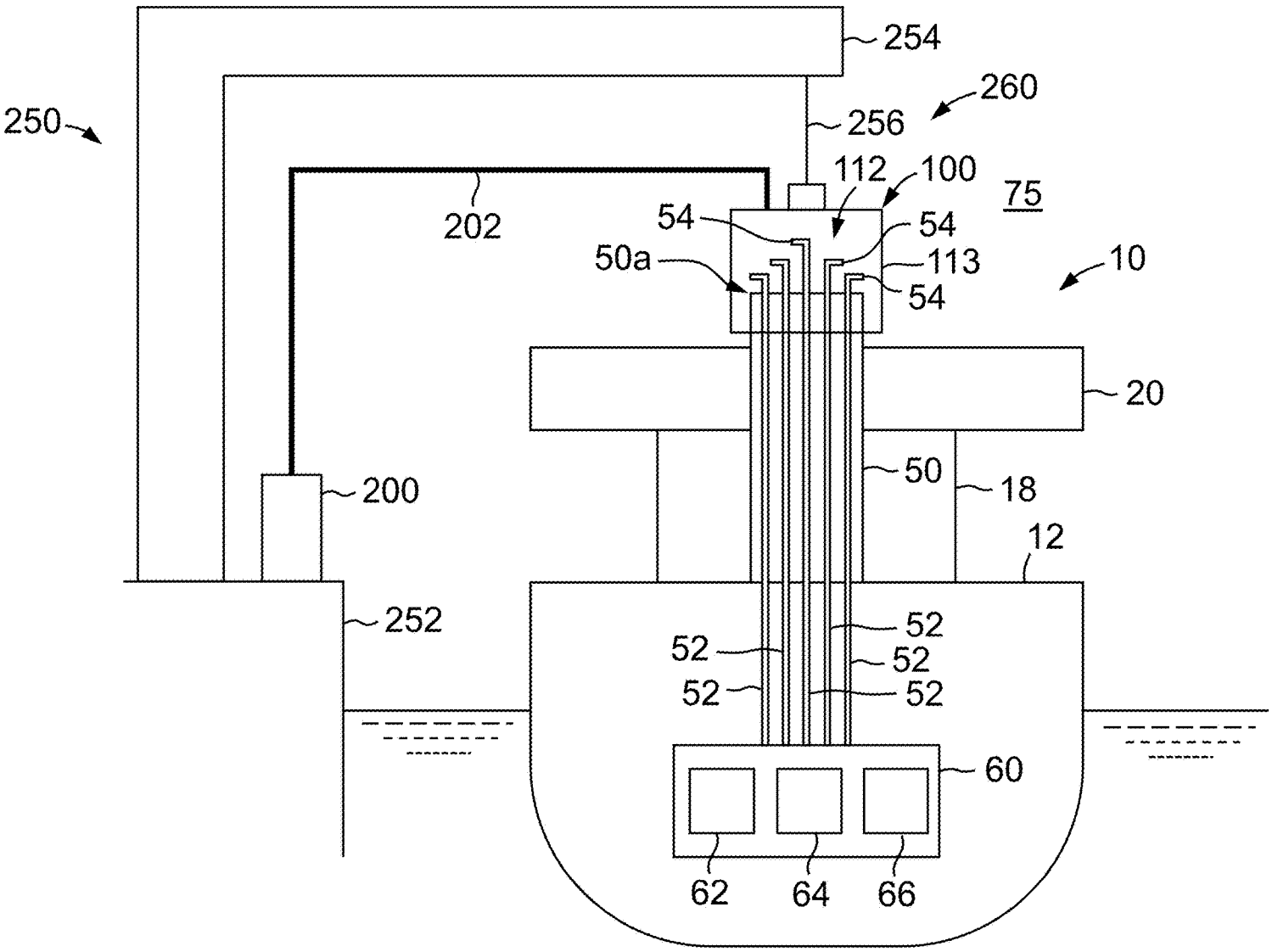
FIG. 2 is a schematic rear view of the marine vessel and an exhaust collection system including the vent hood of FIG. 1 within a berthing location according to some embodiments of the disclosure.

Reference is now made to FIGS. 1 and 2. An exhaust stack 50 may extend upward and away from deck 12. The exhaust stack 50 may sometimes be referred to as an "exhaust funnel." The exhaust stack 50 may be positioned adjacent the accommodation 18 and bridge 20 along deck 12. Specifically, the exhaust stack 50 may be positioned between bridge 20 and rear end 10*a* along deck 12 in some embodiments. Exhaust stack 50 may extend upward from deck 12 to a top end portion 50*a*. One or more (such as one or a plurality of) exhaust pipes 52 extend through exhaust stack 50 and out of the top end portion 50*a*. Specifically, each exhaust pipe 52 has an outlet 54 that is extended out of the exhaust stack 50 and positioned above the top end portion 50*a*.

During operations, each exhaust pipe 52 (or some of the exhaust pipes 52) may output exhaust fluid (or "exhaust"). Specifically, as shown in FIG. 2, each exhaust pipe 52 is in fluid communication with one or more exhaust-emitting systems 62, 64, 66 (collectively referred to as "exhaust-emitting systems 60"). For instance, the exhaust-emitting systems 60 of marine vessel 10 may include diesel electric generator(s) 62, boilers 64, inert gas systems 66, or other systems or assemblies that may output combustion (or other) exhaust during operations. As previously described, the emission of exhaust at a berthing location 250 may degrade air quality at (or near) the berthing location 250 and may even be restricted by local authorities. Accordingly, when the marine vessel 10 is positioned at a berthing location 250, the vent hood 100 may be lowered onto the exhaust stack 50 to collect and route exhaust emitted from the exhaust pipes 52 to an exhaust cleaning assembly 200.

The berthing location 250 may include a port, dock, harbor, mooring, etc. In the embodiment shown in FIG. 2, the berthing location 250 includes a dock 252. The exhaust cleaning assembly 200 may be positioned on the dock 252 (or another onshore location that is within or accessible from the berthing location 250). In some embodiments the exhaust cleaning assembly 200 may be positioned on a barge or other marine vessel that is positioned proximate to (such as alongside) the marine vessel 10 while the marine vessel 10 is at the berthing location 250. In some embodiments, the exhaust cleaning assembly 200 may be remote from the berthing location 250 (such as one or more miles away from the berthing location) and the conduit 202 may include (or be connected to) a suitable pipeline or other suitable infrastructure to transport the exhaust from the berthing location 250 to the remotely located exhaust cleaning assembly 200.

A crane 254 (or other suitable lifting system) positioned at the berthing location 250 may lower the vent hood 100 onto the upper end 50*a* of exhaust stack 50 via suitable rigging 256 (such as a cable, strap, rope, etc.). The crane 254 may be positioned on the dock 252 or may be positioned on a barge or other suitable support at the berthing location 250.

The vent hood 100 may include a housing 113 that defines an enclosure 112 configured to surround (at least partially) the outlets 54 of the exhaust pipes 52 when vent hood 100 is lowered onto exhaust stack 50. An outlet conduit 202 may be connected to an outlet 150 of the housing 113 so that exhaust may flow from the enclosure 112 to the exhaust cleaning assembly 200 via the conduit 202. The conduit 202 may include a flexible conduit (for example, a hose) that may flex, contort, stretch to accommodate any relative movement (such as a lateral shift, heave, etc.) between the exhaust cleaning assembly 200 and marine vessel 10 during operations.

In some embodiments, the vent hood 100 may be lowered onto the exhaust stack 50 so that the outlets 54 of less than all of the exhaust pipes 52 are surrounded (at least partially) by the enclosure 112. Thus, in some embodiments, the outlets 54 of one or more of the exhaust pipes 52 may be positioned outside of the enclosure 112 and the outlets of one or more of the exhaust pipes 52 may be positioned inside the enclosure 112. For instance, without being limited to this or any other theory, outlet pipes 52 associated with the main engine of the marine vessel 10 may not normally emit exhaust (or may not emit a substantial volume of exhaust) when the marine vessel 10 is stationary at a berthing location (such as berthing location 250). Thus, the outlet pipes 52 associated with the main engine of the marine vessel 10 may not be positioned in the enclosure 112 so as to minimize a size and complexity of the vent hood 100. In some embodiments, multiple vent hoods 100 may be lowered onto the exhaust stack 50 (or to multiple exhaust stacks 50 depending on the configuration of the marine vessel 10) so that vent hoods 100 may surrounding (at least partially) different ones or groups of the exhaust pipes 52 during operations.

As is known by one having ordinary skill in the art, within the exhaust cleaning assembly 200, the exhaust may be treated via one or more suitable processes or assemblies to remove some or all of the pollutants or other harmful constituents of the exhaust (for instance, nitrous oxide (NOx), carbon dioxide (CO2), carbon monoxide (CO), soot, etc.). Thus, in some embodiments, the exhaust cleaning system 200 may include one or more reactors 206 such as catalyst reactors, that are configured to treat or clean the exhaust during operations. Additionally or alternatively, in some embodiments, the exhaust cleaning assembly 200 may simply capture and store the exhaust such that the exhaust may then be transferred to a suitable cleaning process or other storage facility. Thus, in some embodiments, the exhaust cleaning assembly 200 may include one or more tanks (or other suitable vessels) 204 that are configured to receive and store the exhaust (or some other fluid such as treated exhaust, treatment fluids, etc.). In either case (such as whether the exhaust is treated or stored via the exhaust cleaning assembly 200), the exhaust emitted from the outlets 54 of exhaust pipes 52 may be prevented from flowing (or mostly restricted from flowing) to the atmosphere 75 at the berthing location 250 after vent hood 100 is lowered onto exhaust stack 50 as shown. As a result, the atmospheric conditions at the berthing location 250 may be improved without having to shut down the exhaust-emitting systems 60 (FIG. 2) of the marine vessel 10.

The vent hood 100, crane 254, and exhaust cleaning assembly 200 may be collectively referred to herein as an exhaust collection system 260 that is positioned (at least partially) at the berthing location 250. Thus, as will be described in more detail herein, exhaust emitted from the marine vessel 10 may be collected and stored and/or processed via the exhaust collection system 260 when the marine vessel 10 is berthed (positioned at the berthing location 250).

Figure 3:
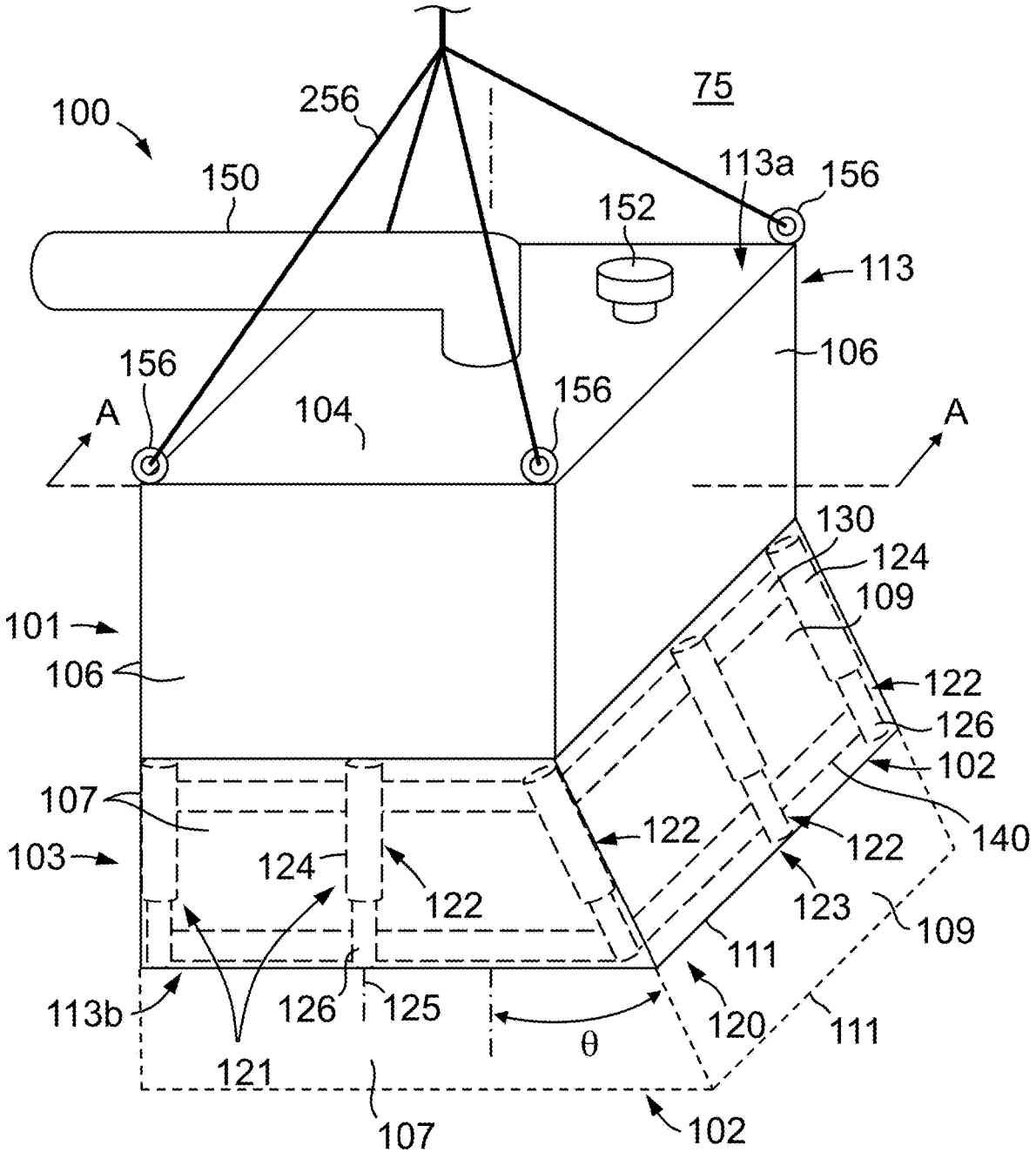
FIG. 3 is a perspective view of the vent hood of FIG. 1 according to some embodiments of the disclosure.
Figure 4:
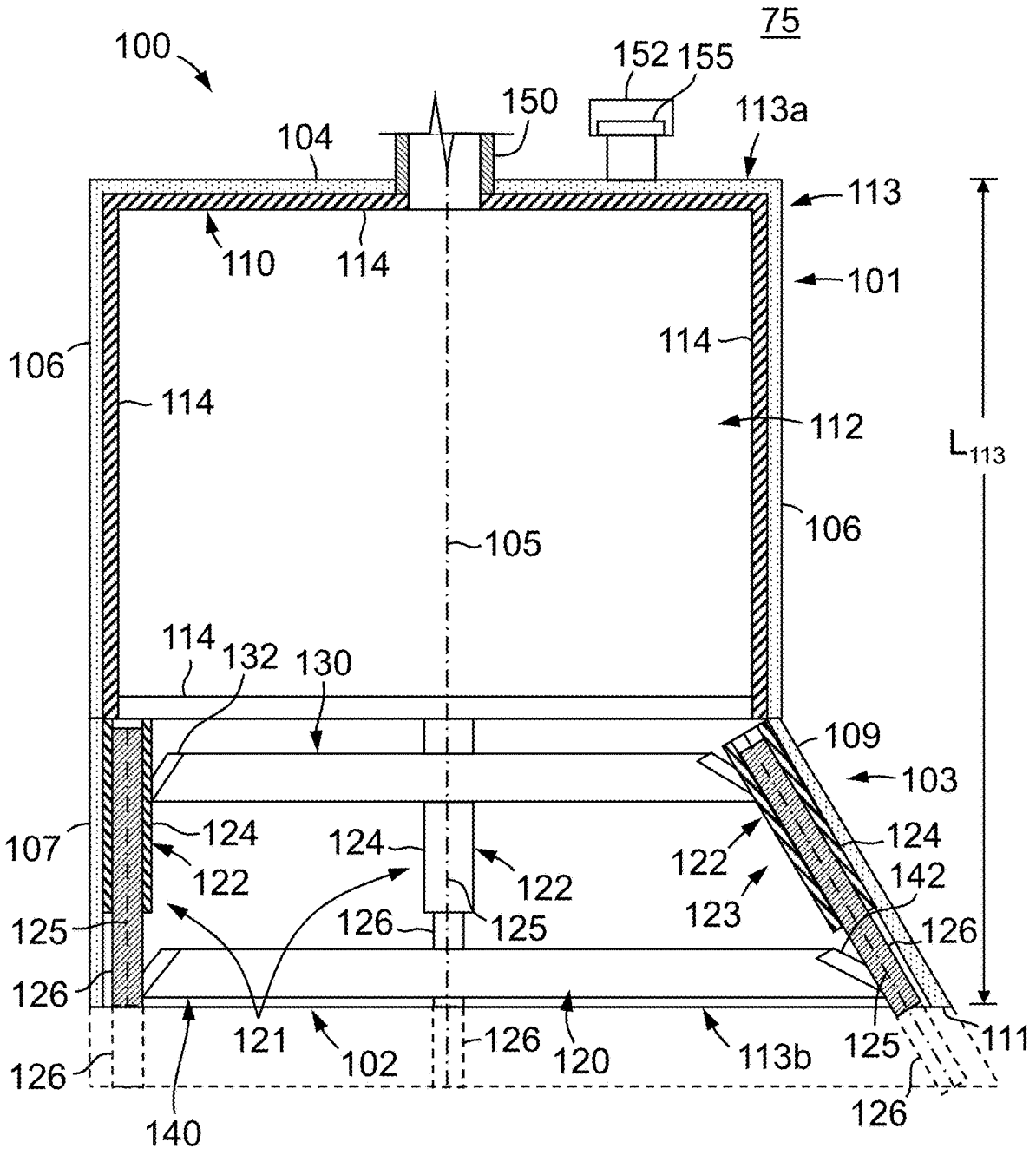
FIG. 4 is a cross-sectional view taken along section A-A in FIG. 3 according to some embodiments of the disclosure.

Reference is now to FIGS. 3 and 4. The housing 113 of vent hood 100 may include a central or longitudinal axis 105 (or more simply "axis 105"), an upper or closed end 113*a*, and a lower or closed end 113*b* spaced from upper end 113*a* along axis 105. Housing 113 may include an opening 102 at the lower end 113*b* that may provide access into the enclosure 112. Thus, the enclosure 112 may be defined within the housing 113 from the opening 102 to the upper end 113*a*. Because the housing 113 may be oriented during operations such that the central axis 105 is generally or substantially aligned with the direction of gravity, the central axis 105 may be referred to herein as a "vertical axis."

As best shown in FIG. 4, the vent hood 100 may include an internal frame 110 positioned within the housing 113 that includes a plurality of frame members 114. The frame members 114 may be elongate members that, when connected together, form an inner structure (or skeleton) of the housing 113. Specifically, an outer covering 108 may be placed over the frame 110 to define the housing 113. In some embodiments, the outer covering 108 may include a non-porous material that may prevent exhaust from passing therethrough during operations. For instance, in some embodiments, the outer covering 108 may include a compliant fabric, rigid plating (such as metallic plating), or some combination thereof. In some embodiments, the outer covering 108 may be a heat resistant and/or flame-retardant material to reduce the risk of damage to the vent hood 100 due to contact with the hot exhaust that may be emitted from the outlets 54 of exhaust pipes 52 during operations (FIGS. 1 and 2).

The housing 113 of vent hood 100 may be formed into a variety of shapes. For instance, as shown in FIGS. 3 and 4, in some embodiments, the housing 113 may include a first or upper portion 101 and a second or lower portion 103. The upper portion 101 includes and extends axially from the upper end 113*a*, and the lower portion 103 includes and extends axially from the lower end 113*b* to the upper portion 101. The outer covering 108 may cover and define both the upper portion 101 and the lower portion 103. However, in some embodiments, the outer covering 108 may cover and define less than all of the upper portion 101 and/or the lower portion 103. For instance, in some embodiments, the outer covering 108 may cover the upper portion 101 and not the lower portion 103, or the outer covering 108 may cover the upper portion 101 and may partially cover the lower portion 103. This, in some embodiments, the outer covering 108 defines the opening 102 at the lower end 113*b* of housing 113.

In some embodiments, the upper portion 101 may be shaped as a rectangular parallelepiped, and the lower portion 103 may be shaped as a truncated right-triangular prism. In particular, the upper portion 101 may include a planar top surface 104 and a plurality of (for instance, four) planar side surfaces 106 extending perpendicularly (or orthogonally) from the top surface 104. The top surface 104 may extend radially relative to the axis 105, and the side surfaces 106 may extend axially relative to the axis 105. The upper portion 101 may include a rectangular cross section along a radial plane extending through central axis 105 so that adjacent ones of the side surfaces 106 may be oriented at 90° to one another and intersect (or meet) at a plurality of (for instance, four) corners. The top surface 104 and the planar side surfaces 106 may be formed or defined by the outer covering 108 in some embodiments.

The outlet 150 extends through the top surface 104 (and thus at the upper end 113*a*) into the enclosure 112. During operations, the outlet 150 may be connected to the conduit 202 (FIGS. 1 and 2) so that exhaust may be routed from the enclosure 112 to the exhaust cleaning assembly 200 as previously described.

In addition, a relief vent 152 (or a plurality of relief vents 152) may be positioned on the top surface 104 (and thus at upper end 113*a*) that fluidly communicate with the enclosure 112. The relief vent 152 may be more simply referred to herein as a "vent 152." The vent 152 may include an actuatable vent. For example, in some embodiments, the vent 152 may have a valve or valve member 155 (such as a gate valve, flapper valve, butterfly valve, etc.) that is actuatable between an open position and a closed position. When the valve member 155 is in the open position, the vent 152 may flow exhaust therethrough and into the surrounding atmosphere 75, and when the valve member 155 is in the closed position, the vent 152 may prevent (or restrict) the flow of exhaust therethrough to the surrounding atmosphere 75. In some embodiments, the valve member 155 of vent 152 may be actuated between the open and closed positions by a controller (such as controller 300 shown in FIG. 11 and described herein) and/or manually by personnel. In some embodiments, the valve member 155 of vent 152 may be pressure actuated (such that the vent 152 may be a "pressure-actuated vent"). Specifically, in some embodiments, the valve member 155 may include a biased valving assembly that is configured to open when a sufficient differential pressure is applied across the vent 152 (and against the bias provided by the biased valving assembly). For instance, in some embodiments, the valve member 155 may be biased to the closed position (such as via a spring or other suitable biasing member or assembly), and when a pressure within the enclosure 112 rises above a threshold, the valve member 155 may transition from the closed position to the open position to allow exhaust to flow out of the enclosure 112 to the surrounding atmosphere 75.

Further, as shown in FIG. 3, one or more attachment members 156 (such as lifting eyes) may be positioned on or proximate to top surface 104 (or at other points of vent hood 100). The attachment members 156 may engage with the rigging 256 to suspend the housing 113 of vent hood 100 from the crane 254 (FIG. 2) during operations.

In some embodiments, one or more sides of the lower portion 103 may be radially extendable or retractable relative to the central axis 105 so as to adjust the size of the opening 102 during operations. For instance, as shown in FIGS. 3 and 4, the lower portion 103 of housing 113 may include a plurality of (for instance, three) first planar side surfaces 107 that extend axially relative to the central axis 105. Thus, the planar side surfaces 107 may be flush (or co-planar) and continuous with some (for instance, three) of the side surfaces 106 of upper portion 101. In addition, the lower portion 103 includes a second planar side surface 109 that is oriented at an acute angle θ relative to the central axis 105 (such that the angle θ is greater than 0° and less than) 90°. Thus, the second planar side surface 109 may diverge radially away from the central axis 105 when moving axially along the central axis 105 toward the lower end 113*b*. The side surfaces 107, 109 may be formed or defined by the outer covering 108 in some embodiments.

The frame 110 may include or define an engagement adjustment assembly 120 (or more simply "adjustment assembly") within the lower portion 103. As will be described in more detail below, the adjustment assembly 120 may be actuated to adjust (such as increase or decrease) a size of the opening 102 to allow the vent hood 100 to engage with exhaust stacks (such as exhaust stack 50) having different sizes and/or shapes. In some embodiments, the adjustment assembly 120 may adjust the size of the opening 102 by adjusting (such as increasing or decreasing) an axial length $L_{113}$ of the housing 113 measured axially between the upper end 113*a* and the lower end 113*b* along the axis 105 (FIG. 4). Because the lower portion 103 includes the second planar side surface 109 that is oriented at the acute angle θ to the central axis 105 as previously described, as the axial length of the lower portion 103 and the axial length $L_{113}$ of housing 113 increases, a lower end (or lower edge) 111 of the second side surface 109 (which may be positioned at the lower end 113*b* of housing 113) may move or diverge radially outward or away from the central axis 105 so that the opening 102 (particularly the surface area of opening 102 in a radially oriented plane through the central axis 105) is increased. The dotted lines in FIGS. 3 and 4 illustrate the increased size of the opening 102 upon increasing the axial length $L_{113}$ of housing 113 according to some embodiments. Conversely, as the axial length of the lower portion 103 and the axial length $L_{113}$ of housing 113 decreases, the lower end (or lower edge) 111 of the second side surface 109 may converge radially inward toward the central axis 105 so that the opening 102 (particularly the surface area of opening 102 in a radially oriented plane through the central axis 105) is decreased.

In some embodiments, the adjustment assembly 120 may include a plurality extendable frame members 122 that are configured to extend and retract to facilitate the axial extension and retraction of lower portion 103 of housing 113 during operations. In particular, in some embodiments, each of the plurality of extendable frame members 122 includes an outer sheath 124, and an elongate inner member 126 telescopically nested within the outer sheath 124 such that the outer sheath 124 and inner member 126 are coaxially aligned along a common central axis 125. For each (or some) of the plurality of extendable frame members 122, the outer sheath 124 may be connected to the rest of the frame 110, particularly the frame members 114 within the upper portion 101, and the inner member 126 may be connected to the outer covering 108.

The extendable frame members 122 may be positioned and spaced along an outer perimeter of the lower portion 103. Thus, a first set 121 of the plurality of extendable frame members 122 are positioned along the first planar side surfaces 107, within the enclosure 112, and a second set 123 of the plurality of extendable frame members 122 are positioned along the second planar side surface 109 within the enclosure 112. The central axes 125 of the first set 121 of the plurality of extendable frame members 122 may be substantially parallel with (and radially offset from) the central axis 105, and the central axes 125 of the second set 123 of the plurality of extendable members 122 may be generally oriented at the angle θ relative to the central axis 105.

During operations, each of the plurality of extendable frame members 122 may extend or retract along the corresponding axes 125 to facilitate the axial extension or retraction of the lower portion 103 along axis 105 as previously described. Specifically, for each of the plurality of extendable frame members 122, the inner member 126 may extend out of or retract into the outer sheath 124 along the axis 125. As previously described, the inner members 126 may be connected to the outer covering 108 along the lower portion 103. Accordingly, as the inner members 126 extend from or retract into the outer sheath 124, the outer covering 108 is expanded or contracted in a generally axial direction along the axis 105. Thus, as the inner members 126 of the extendable frame members 122 extend from the corresponding outer sheaths 124, the outer covering 108 is extended axially within the lower portion 103 to thereby increase the size of the opening 102 as previously described, and as the inner members 126 of the extendable frame members 122 retract into the corresponding outer sheaths 124, the outer covering 108 is retracted axially within the lower portion 103 to thereby decrease the size of the opening 102 as previously described. As previously described, in some embodiments, the outer covering 108 includes a fabric. Thus, in these embodiments, the outer covering 108 may stretch, crumple, fold, etc. as necessary to accommodate the axial extension and retraction of the lower portion 103 and the corresponding increase and decrease in the size of opening 102 during operations. As is also previously described, in some embodiments, the outer covering 108 may include rigid (for instance, metallic) plating.

Thus, in these embodiments, the metallic plating of the portion of the outer covering 108 that covers the lower portion 103 may include layers of rigid plating that slide relative to one another to accommodate both the axial extension and retraction of the lower portion 103 and the increase and decrease, respectively, of the opening 102 during operations.

Figure 5:
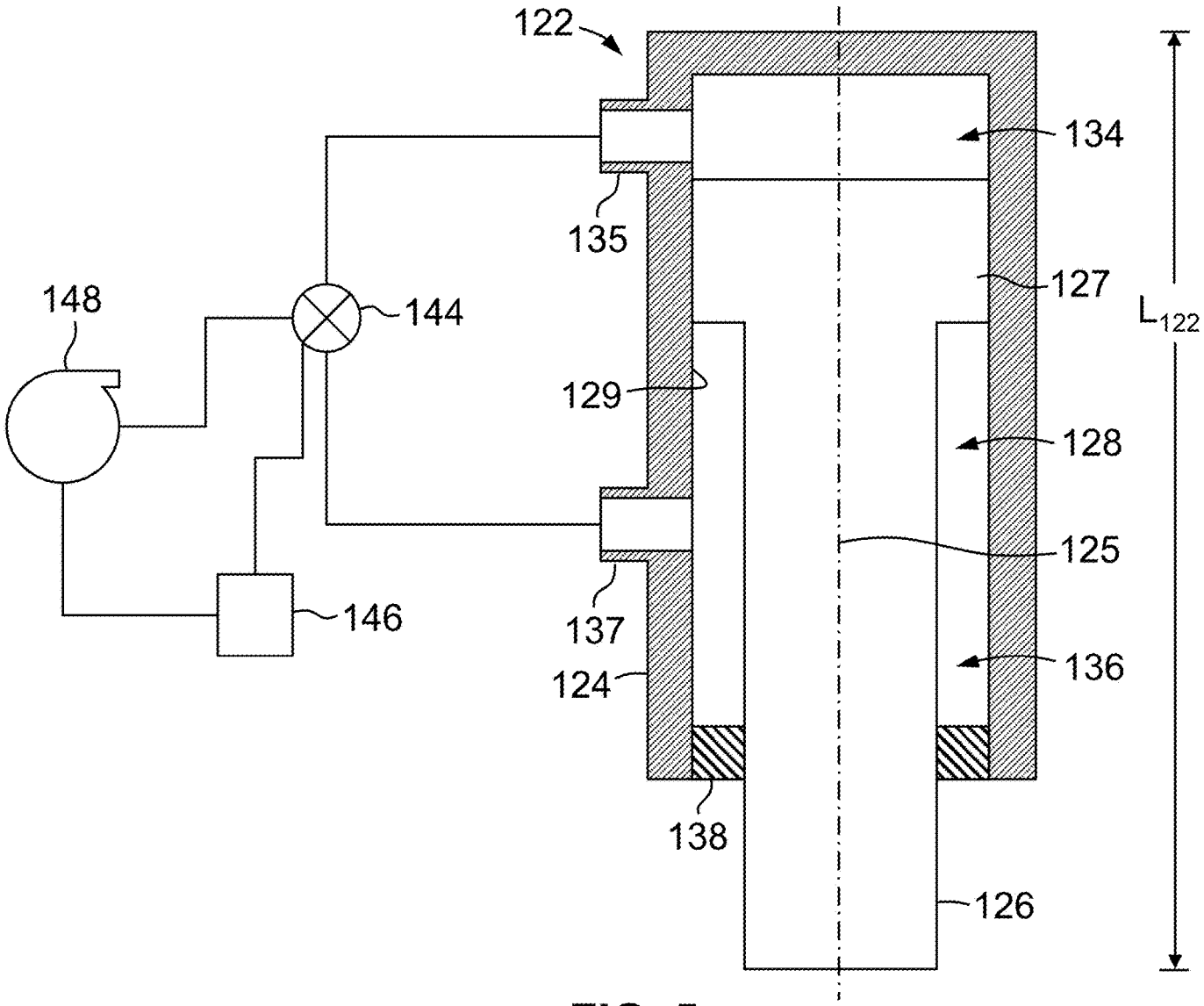
FIG. 5 is a schematic view of an extendable frame member of an engagement adjustment assembly of the vent hood of FIG. 3 according to some embodiments of the disclosure.

In some embodiments, one or more of the extendable frame members 122 may be powered to extend or retract the inner member 126 out of or into, respectively, the outer sheath 124 to thereby drive the axial extension or retraction, respectively, of the lower portion 103 of vent hood 100 (FIGS. 3 and 4) during operations. For instance, as shown in FIG. 5, in some embodiments, one or more (for example, all) of the plurality of extendable frame members 122 may be configured as an extendable piston-cylinder assembly, such as a hydraulic or pneumatic cylinder. In these embodiments, the inner member 126 may include or be connected to a piston 127 that is slidably positioned within a chamber 128 formed within the outer sheath 124. The chamber 128 may include a closed end 128*a* and an open end 128*b* opposite closed end 128*a*. The inner member 126 may extend out of the chamber 128 at the opening end 128*b*. The piston 127 may sealingly engage with an inner wall 129 of the chamber 128 (such as via an O-ring or other suitable sealing member) so that the piston 127 separates the chamber 128 into a first portion 134 extending from the closed end 128*a* to the piston 127 and a second portion 136 extending from the piston 127 to the open end 128*b*. An annular seal 138 (such as seal ring(s), wiper seal(s), packing, etc.) may be positioned at the open end 128*b* that sealingly engages with the inner member 126 to seal the second portion 136 from the outer environment (such as outside of the chamber 128). The piston 127 and inner member 126 may axially move within the chamber 128 along axis 125 as previously described, such that the portions 134 ,136 of the inner chamber 128 may have variable volumes based on an axial position of the piston 127 within the chamber 128. Thus, portions 134, 136 may be referred to as "variable volume chambers."

A fluid (such as hydraulic fluid, air, etc.) may be selectively injected into the first portion 134 or the second portion 136 via ports 135, 137, respectively, so as to translate the piston 127 and inner member 126 along the axis 125 within the chamber 128 and thereby extend or retract the inner member 126 out of or into the outer sheath 124 as previously described. The ports 135, 137 may be connected to a control valve 144 that is also in fluid communication with a fluid reservoir 146 and a pump 148. The pump 148 may pressurize fluid for injection into either the first portion 134 or the second portion 136 during operations. In some embodiment, the pump 148 may output pressurized fluid to an accumulator vessel (not shown) that may maintain a pressure upstream of the control valve 144.

During operations, the control valve 144 may be selectively actuated between a plurality of positions (such as by a controller such as controller 300 shown in FIG. 11 and described herein) to flow fluid (such as hydraulic fluid, air, etc.) to and/or from the portions 134, 136 of chamber 128 and thereby selectively extend or retract the inner member 126 from the outer sheath 124 and thereby adjust the axial length L122 of extendable frame member 122 along axis 125. For instance, in some embodiments, the control valve 144 may be actuated to a first position in which fluid is flowed from the pump 148 (or a suitable accumulator vessel connected to pump 148) to the first portion 134 and in which fluid is emitted from the second portion 136 to the reservoir 146 via the control valve 144. In the first position, the increased volume of fluid injected into the first portion 134 may cause the inner member 126 to translate axially outward from the outer sheath 124 along axis 125 (such as outward from chamber 128) via the piston 127 to thereby increase the axial length L122 of extendable frame member 122. In some embodiments, the control valve 144 may be actuated to a second position in which fluid is flowed from the pump 148 (or a suitable accumulator vessel connected to pump 148) to the second portion 136 and in which fluid is emitted from the first portion 134 to the reservoir 146. In the second position, the increased volume of fluid injected into the second portion 136 may cause the inner member 126 to translate axially into the outer sheath 124 along axis 125 (such as into chamber 128) via the piston 127 to thereby decrease the axial length L122 of extendable frame member 122. Thus, by selectively actuating the control valve 144 between the plurality of positions, the inner member 126 of one or more of the extendable frame members 122 may be extended or retracted so as to drive the axial extension or retraction of the lower portion 103 and the corresponding increase or decrease in the size of the opening 102 of housing 113 of vent hood 100 as previously described (FIGS. 3 and 4).

Other actuation methods and devices for the adjustment assembly 120 are contemplated for other embodiments. In some embodiments, a motor or driver that is separate from (and potentially connected to) the extendable frame members 122 may be used to selectively extend or retract lower portion 103 of housing 113 as previously described. For instance, in some embodiments, a separate motor (such as a stepper motor, servo motor, etc.) may be connected to the adjustment assembly 120, including one or more of the extendable frame members 122 and actuated to selectively extend or retract the lower portion 103 along axis 105 as previously described.

Referring again to FIGS. 3 and 4, one or more (such as one or a plurality of) seals 130, 140 are positioned (at least partially) within the enclosure 112. Specifically, the one or more seals 130, 140 may be positioned at least partially within the lower portion 103 of housing 113. In some embodiments, the seals 130, 140 are connected to the engagement adjustment assembly 120 within the lower portion 103. The seals 130, 140 may include a first or upper seal 130 and a second or lower seal 140. The lower seal 140 may be positioned axially between the upper seal 130 and the lower end 113*b* of the vent hood 100. The upper seal 130 may be referred to herein as a "primary seal" and the lower seal 140 may be referred to herein as a "secondary seal," because exhaust may first flow past the upper seal 130 before reaching the lower seal 140 when flowing out of the enclosure 112 at the lower end 113*b*.

In some embodiments, the upper seal 130 and/or the lower seal 140 may engage with the outer surface of the exhaust stack 50 of marine vessel 10 (FIGS. 1 and 2) to prevent or at least restrict exhaust from leaking from enclosure 112 via the opening 102. In some embodiments, the upper seal 130 and/or the lower seal 140 may include compliant sealing members (for example, elastomeric seals). As shown in FIG. 4, in some embodiments, the upper seal 130 and/or the lower seal 140 may include a baffle plate 132, 142, respectively, that may engage with the outer surface of the exhaust stack 50 (FIGS. 1 and 2). In some embodiments, the upper seal 130 and the lower seal 140 may be configured to expand and contract with the opening 102 when the lower portion 103 is extended and retracted axially relative to the upper portion 101 as previously described. For instance, in some embodiments, the upper seal 130 and/or the lower seal 140 may include one or more independent and separate sections or portions that are connected to the side surfaces 107, 109. Specifically, the upper seal 130 and/or the lower seal 140 may include one or more portions that are connected to the first side surfaces 107 of lower portion 103 and one or more portions that are connected to the second side surface 109 of lower portion 103. Thus, as the lower portion 103 is axially expanded or retracted relative to upper portion 101 as previously described, the one or more portions of the upper seal 130 and/or lower seal 140 that are connected to the second side surface 109 may radially diverge away from and converge toward, respectively, the central axis 105 along with the side surface 109 independently of the one or more portions connected to the side surfaces 107. In some embodiments, the upper seal 130 and/or the lower seal 140 may include a compliant material that may allow the seals 130, 140 to stretch and contract to accommodate the adjustments in the size of the opening 102 during operations. In some embodiments, the upper seal 130 and/or the lower seal 140 may include a pneumatic seal such as an inflatable bag. In some embodiments, the upper seal 130 and/or the lower seal 140 may include clamps, vice grips, or other suitable mechanisms for engaging with the exhaust stack 50 during operations. In some embodiments, the upper seal 130 and/or the lower seal 140 may be configured to engage the exhaust stack 50 via an electro-magnetic system, mechanism, or device. In some embodiments, the upper seal 130 may be connected to the side surfaces 107, 109 and the outer sheaths 124 of the plurality of extendable frame members 122, and the lower seal 140 may be connected to the side surfaces 107, 109 and the inner members 126 of the plurality of extendable frame members 122.

Figure 6:
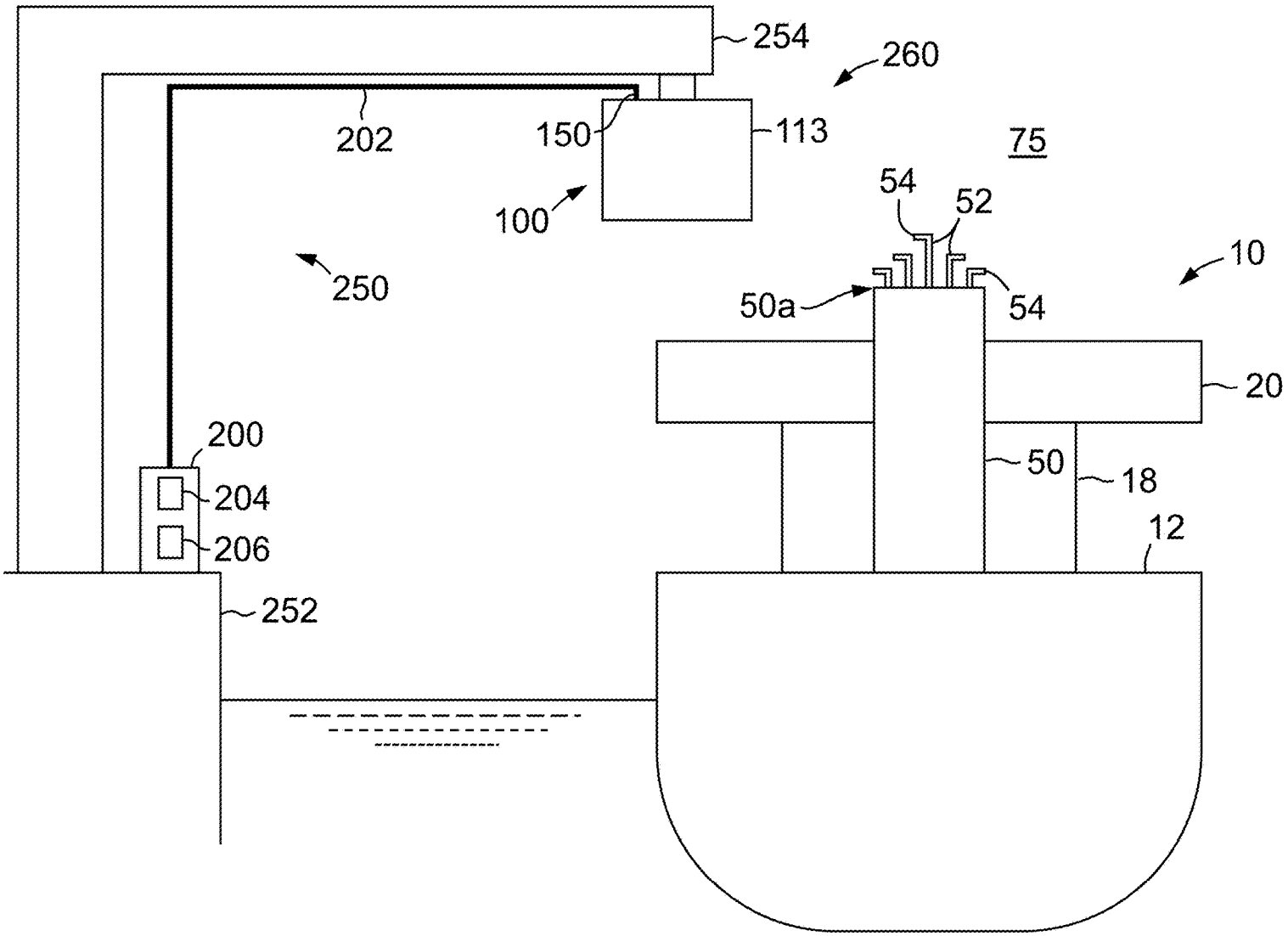
FIGS. 6-8 are sequential rear views of a sequence or method for capturing exhaust emitted from the marine vessel via the exhaust collection system of FIG. 2 when the marine vessel is positioned at a berthing location according to some embodiments of the disclosure.
Figure 7:
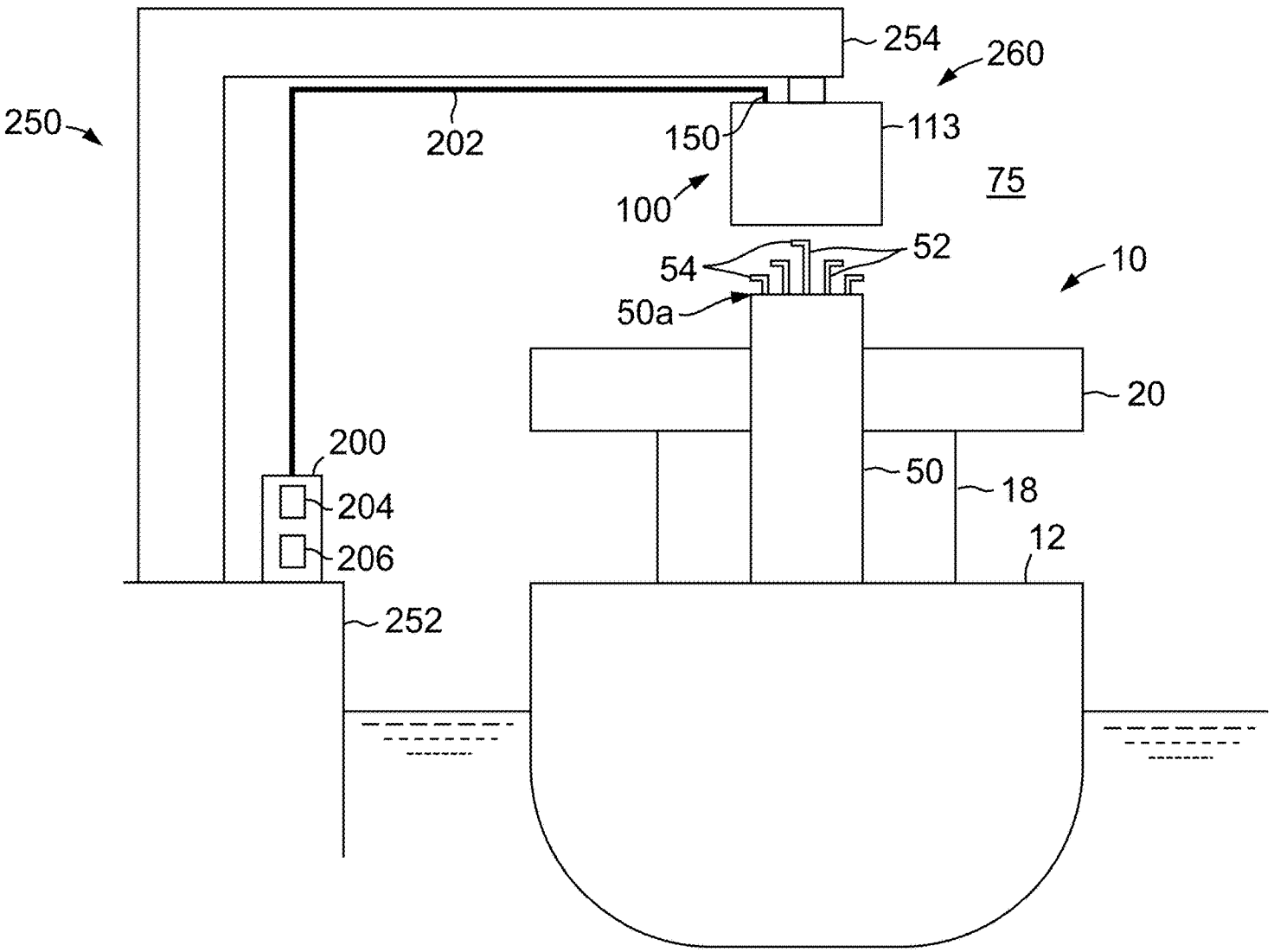
Figure 8:
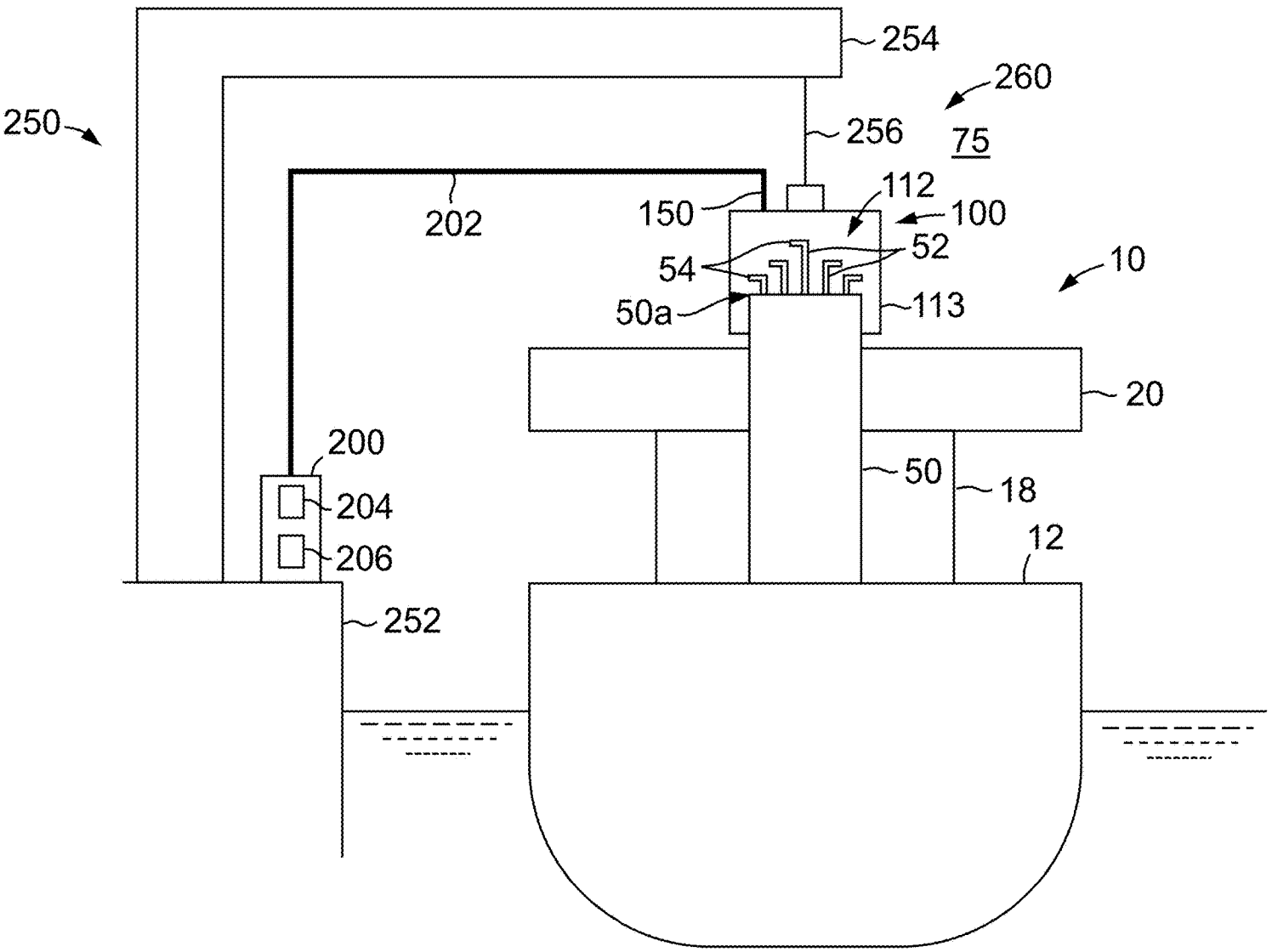

FIGS. 6-8 show an example sequence or method for capturing exhaust emitted from the marine vessel 10 via an exhaust collection system 260 when the marine vessel 10 is positioned at a berthing location 250 (such that the marine vessel 10 is berthed) according to some embodiments. In describing the sequence shown in FIGS. 6-8, continuing reference will be made to the various features of embodiments of marine vessel 10 and vent hood 100 shown in FIGS. 1-5 and previously described above.

Initially, as shown in FIGS. 6 and 7, the marine vessel 10 may travel toward the berthing location 250. For instance, as previously described, the berthing location 250 may include a port, dock, harbor, mooring, etc., and the marine vessel 10 may travel to the berthing location 250 for any suitable reason (such as to offload or receive cargo, undergo repairs, refuel, offload or receive personnel, undergo inspection, etc.). When the marine vessel 10 is traveling (such as across a body of water such an ocean, lake, channel, etc.), the exhaust emitted from exhaust stack 50 (particularly from the exhaust pipes 52 extending through exhaust stack 50), may be vented to the surrounding atmosphere 75 via the outlets 54 of exhaust pipes 52. An exhaust cleaning assembly 200 may be positioned at (or accessible from) the berthing location 250 as previously described. For instance, as previously described, the exhaust cleaning assembly 200 may be positioned on a barge that is floating on the water within the berthing location 250, or the exhaust cleaning assembly 200 may be positioned onshore (such as on dock 252) at the berthing location 250 (or at a remote location from the berthing location 250 and accessible via pipeline or other suitable infrastructure as previously described). FIGS. 6 and 7 show the exhaust cleaning assembly 200 to be positioned onshore on the dock 252 at the berthing location 250.

Figure 10:
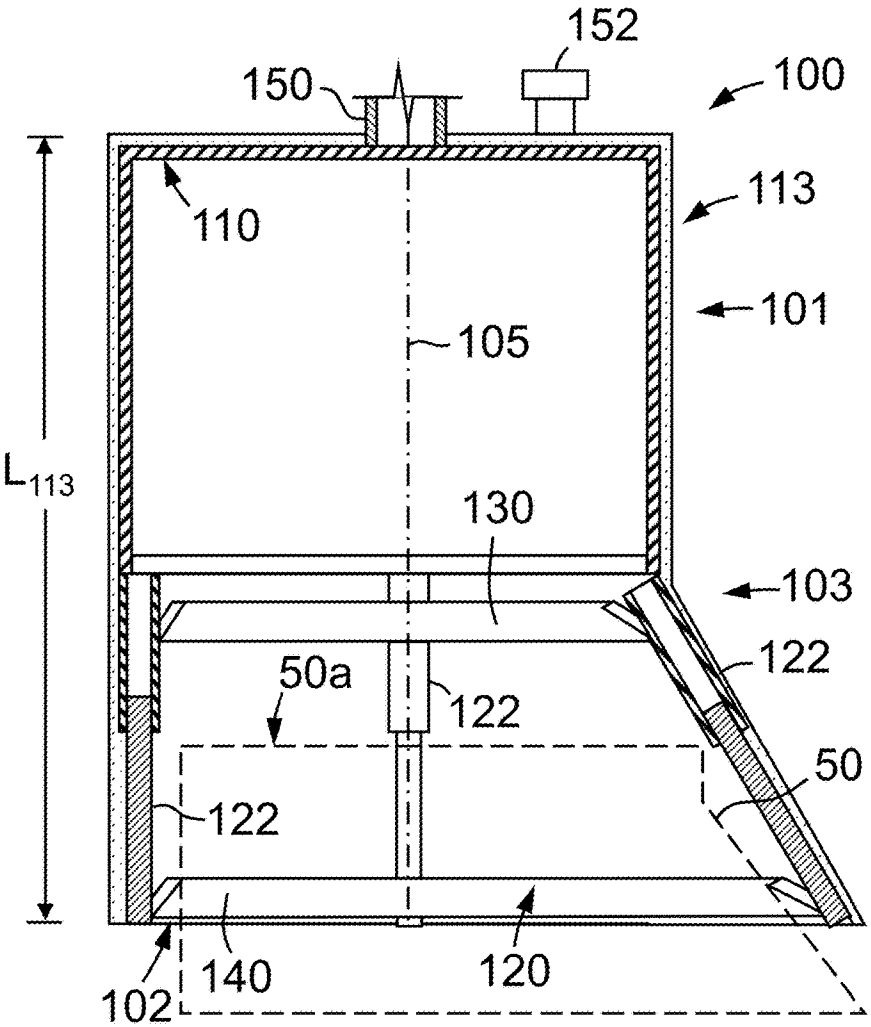
FIGS. 9 and 10 are cross-sectional views taken along section A-A in FIG. 3 of the vent hood showing the lower portion and opening of the vent hood actuated to accommodate different sized and/or shaped exhaust stacks according to some embodiments of this disclosure.
Figure 9:
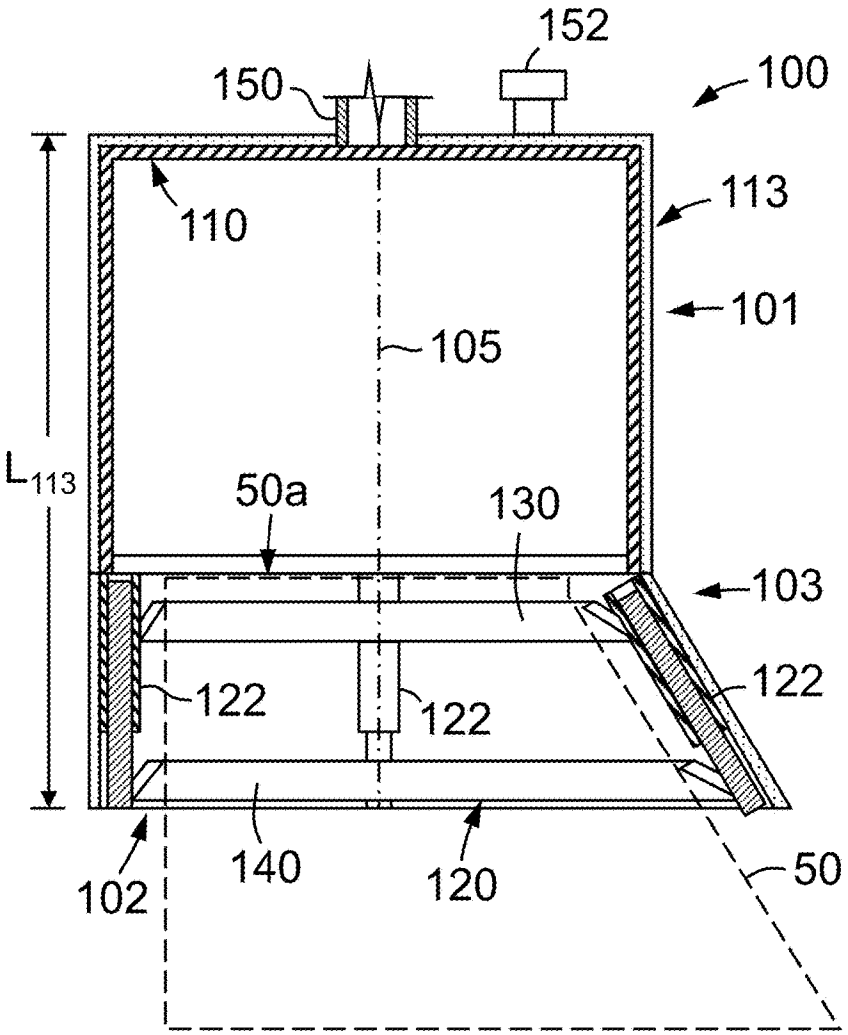

As shown in FIG. 8, once the marine vessel 10 is positioned within the berthing location 250, the housing 113 of vent hood 100 may be lowered onto the exhaust stack 50 via crane 254 and rigging 256 so as to surround (at least partially) the outlets 54 of outlet pipes 52 with the enclosure 112 as previously described. As previously noted, the size and/or shape of the exhaust stack 50 of different marine vessels 10 may be varied. Thus, as shown in FIGS. 9 and 10, as a part of engaging the housing 113 with the exhaust stack 50, the adjustment assembly 120 (or one or more of the extendable frame members 122 of adjustment assembly 120) may be actuated to extend or retract the lower portion 103 of housing 113 along axis 105 so as to selectively increase or decrease, respectively, the size of the opening 102 to correspond with the size and/or shape of the exhaust stack 50 (particularly the upper end 50*a* of exhaust stack 50). Specifically, as shown in FIG. 9, in some embodiments, the lower portion 103 may be retracted to decrease the axial length $L_{113}$ of housing 113 and to decease the size of the opening 102 so that one or both upper seal 130 and lower seal 140 may engage with an outer surface of a smaller exhaust stack 50. As shown in FIG. 10, in some embodiments, the lower portion 103 may be extended to increase the axial length $L_{113}$ of housing 113 and to increase the size of the opening 102 for a larger exhaust stack 50 so that one or both of the seals 130, 140 (such as the lower seal 140) may engage with an outer surface of the exhaust stack 50. As previously described, in some embodiments, the lower portion 103 may be extended or retracted along axis 105 via actuation of one or more of the extendable frame members 122 (such as when the one or more extendable frame members 122 are configured as piston-cylinder assemblies as shown in FIG. 5 and previously described) or another motor or driver of or coupled to the adjustment assembly 120.

As shown in FIG. 8, once the housing 113 of vent hood 100 is situated atop the exhaust stack 50, the exhaust emitted from outlets 54 of outlet pipes 52 may flowed into the enclosure 112 and then out to the exhaust cleaning assembly 200 via the outlet 150 and conduit 202. Thereafter, when the time comes for marine vessel 10 to depart from the berthing location 250, the housing 113 may be lifted away from the exhaust stack 50 via crane 254 and rigging 256 and the marine vessel 10 may travel out of and away from the berthing location 250. Once the housing 113 is lifted off of exhaust stack 50 and while marine vessel 10 is traveling out of and away from the berthing location 250, any exhaust emitted from exhaust stack 50 (particularly the one or more exhaust pipes 52) may once again be emitted directly to the surrounding atmosphere 75 via the outlets 54 of exhaust pipes 52. Accordingly, when the marine vessel 10 is berthed (such as at a berthing location) exhaust-emitting systems (such as exhaust-emitting systems 60 shown in FIG. 2) may continue to operate so as to support operation of the marine vessel 10 and any sub-systems thereof, and exhaust may be prevented (or restricted) from being emitted into the surrounding atmosphere 75 within the berthing location 250. As a result, the air quality of a berthing location 250 may be maintained, even is multiple marine vessels 10 are positioned therein at a given time.

Figure 11:
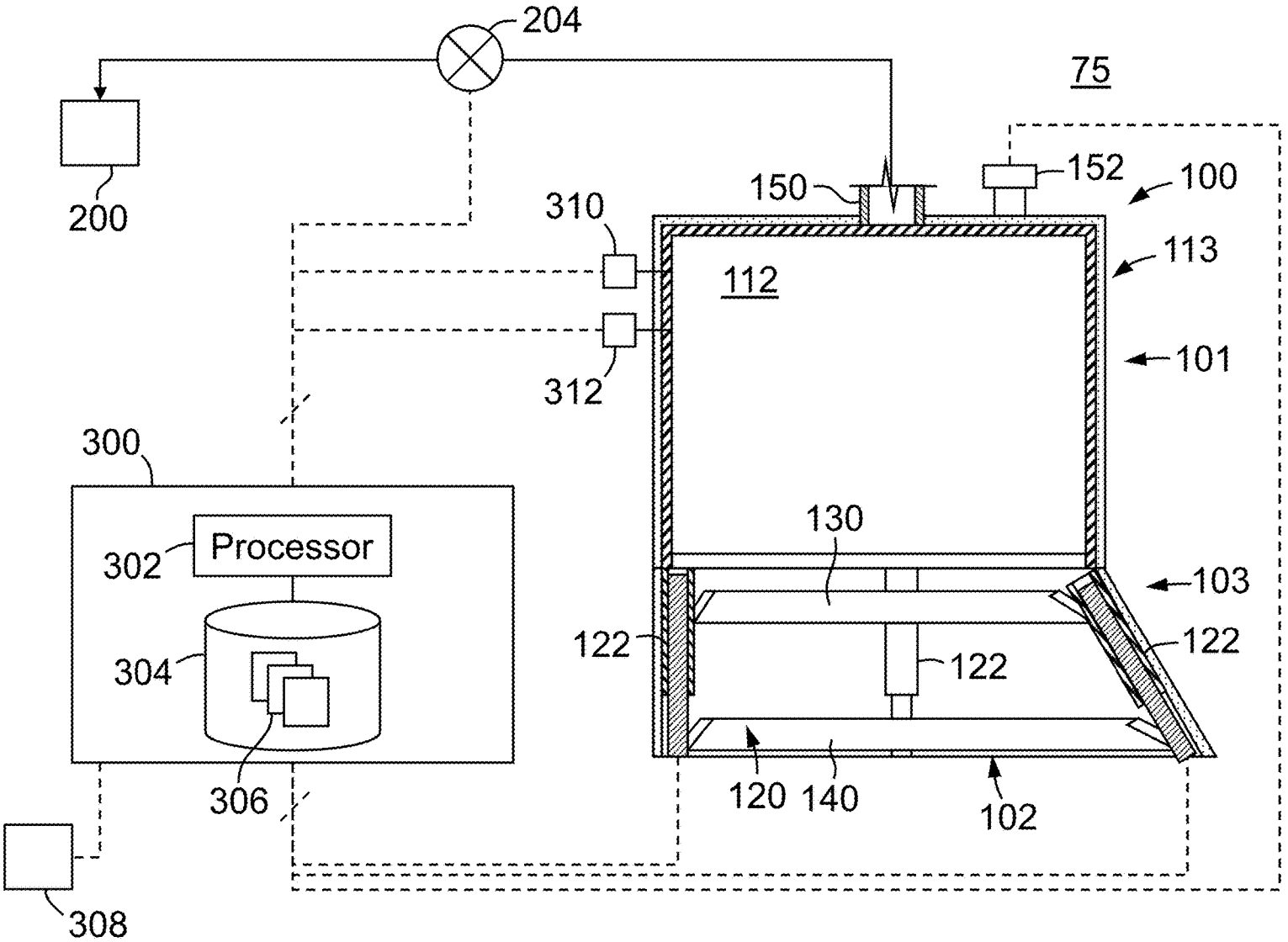
FIG. 11 is a schematic view of the vent hood of FIG. 1 further showing a controller for controlling the flow of exhaust through the vent hood according to some embodiments of the disclosure.

Reference is now made to FIG. 11. In some embodiments, a controller 300 may be used to control one or more functional aspects of the vent hood 100 and related systems and assemblies during operations. The controller 300 may be positioned at or remote from the berthing location 250. In some embodiments the controller 300 may be positioned onboard the marine vessel 10 (for instance, as a main or master controller of the marine vessel 10 or as a standalone controller for the vent hood 100). Regardless as to its precise location, the controller 300 may be described herein as being part of the exhaust collection system 260 (FIG. 2).

The controller 300 may be a computing device, such as a computer, tablet, smartphone, server, or other computing device or system. Thus, controller 300 may include a processor 302 and a memory 304. The processor 302 may include any suitable processing device or a collection of processing devices. In some embodiments, the processor 302 may include a microcontroller, central processing unit (CPU), graphics processing unit (GPU), timing controller (TCON), scaler unit, or some combination thereof. During operations, the processor 302 executes machine-readable instructions 306 stored on memory 304, thereby causing the processor 302 to perform some or all of the actions attributed herein to the controller 300. In general, processor 302 fetches, decodes, and executes instructions (such as machine-readable instructions 306). In addition, processor 302 may also perform other actions, such as, making determinations, detecting conditions or values, etc., and communicating signals. If processor 302 assists another component in performing a function, then processor 302 may be said to cause the component to perform the function.

The memory 304 may be any suitable device or collection of devices for storing digital information including data and machine-readable instructions (such as machine-readable instructions 306. For instance, the memory 305 may include volatile storage (such as random access memory (RAM)), non-volatile storage (such as flash storage, read-only memory (ROM), etc.), or combinations of both volatile and non-volatile storage. Data read or written by the processor 302 when executing machine-readable instructions 306 can also be stored on memory 304. Memory 304 may include "non-transitory machine-readable medium," where the term "non-transitory" does not include or encompass transitory propagating signals.

The processor 302 may include one processing device or a plurality of processing devices that are distributed within controller 300 or within exhaust collection system 260 (FIG. 2). Likewise, the memory 304 may include one memory device or a plurality of memory devices that are distributed within exhaust collection system 260 (FIG. 2).

The controller 300 may be communicatively connected (such as via wired and/or wireless connection) to a user interface 308 (such as a monitor, display, computing device, touch-sensitive screen or other surface, keyboard, mouse, or some combination thereof). During operations, a user (such as personnel at the berthing location 250, onboard the marine vessel 10, etc.) may view information output from the controller 300 on the user interface 308 (such as the position or status of one or more of the sensors 310, 312, vent(s) 154, valve 204, adjustment assembly 120, etc.). In addition, during operations, a user may make inputs to the controller 300 via the user interface 308 (such as commands to open valve 204 and/or vent(s) 154, to actuate adjustment assembly 120, etc.).

Controller 300 may be connected (such as via wired and/or wireless connection) to various sensors (for instance, sensors 310, 312) connected to the vent hood 100. For instance, controller 300 may be connected to a pressure sensor 310 and temperature sensor 312 that are connected to the vent hood 100 and configured to detect or measure a pressure and temperature, respectively, within the enclosure 112 (or value indicative thereof). The pressure sensor 310 may be any suitable device that is configured to measure, detect, or determine a pressure (or value indicative thereof) within a given area, volume, location (for instance, enclosure 112). For instance, in some embodiments, the pressure sensor 310 may include strain gauges, capacitance-based pressure sensors, solid-state pressure sensors, manometers, barometers, resistive pressure sensors, semiconductor circuit, etc. In addition, the temperature sensor 312 may be any suitable device that is configured to measure, detect, or determine a temperature (or value indicative thereof) within a given area, volume, or location (for instance, enclosure 112). For instance, in some embodiment, the temperature sensor 312 may include a thermocouple, thermistor, resistance temperature detector (RTD), semiconductor circuit, etc.

In addition, controller 300 may be connected to a valve 204 positioned along (or otherwise connected to) conduit 202. In addition, controller 300 may be connected to the vent 152. For instance, the valve 204 and/or the vent 152 may include motorized or actuatable valves that may be transitioned between the open and closed positions (previously described above) via the controller 300 (or a command or signal generated thereby). In addition, controller 300 may be connected to the valve 204 and/or the vent 152 such that controller 300 may determine a position (for instance, open, closed, or a position between fully open or fully closed) of the valve 204 and/or the valve member 155 of vent 152. For instance, the valve 204 and/or the vent 152 may include or be connected to a driver such as a stepper motor, servo-motor, or other suitable device that may controllably place the valve 204 and/or the valve member 155 of vent 152 in a particular position. The controller 300 may determine a position of the valve 204 and/or the vent 152 via the previous actuation(s) of the drivers (such as stepper motor, servo-motor, etc.). In some embodiments, one or more additional sensors or devices, such as position sensors, proximity sensors, pressure sensors (such as differential pressure sensors), optical sensors, etc. may be utilized by controller 300 to determine a position of the valve 204 and/or the vent 152.

During operations, controller 300 may selectively actuate the valve 204 and/or the vent 152 between the open and closed positions so as to flow the exhaust emitted from the one or more exhaust pipes 52 out of the enclosure 112 when the housing 113 of vent hood 100 is positioned atop the exhaust stack 50 as previously described (FIG. 1). For instance, when marine vessel 10 is at berth (such as shown in FIGS. 1 and 8 and previously described above), and a conduit (such as conduit 202) is engaged with the outlet 150, the controller 300 may open the valve 204 and close the vent 152 so that exhaust emitted from the one or more exhaust pipes 52 may be directed into an exhaust cleaning assembly (such as exhaust cleaning assembly 200) via the conduit 202 as previously described. In addition, if the pressure and/or temperature within the enclosure 112 raises above a threshold (such as due to the emission of exhaust therein), the controller 300 may open the vent 152 to allow exhaust emitted from the one or more exhaust pipes 52 to be vented to the surrounding atmosphere 75 either in addition to or in lieu of flowing the exhaust to the exhaust cleaning assembly 200 via conduit 202. In some embodiments, if the pressure and/or the temperature within the enclosure 112 remains above a threshold, the controller 300 may cause the crane 254 to lift the vent hood 100 off of the exhaust stack 50 and/or may output an alarm (which may trigger personnel or another controller to lift vent hood 100 via the crane 254). Thus, in some embodiments, the controller 300 may be communicatively connected to the crane 254 (or with a controller thereof). The controller 300 may determine the pressure and temperature within the enclosure 112 based on outputs received from the sensors 310, 312.

In some embodiments the vent 152 may be pressure-actuated as previously described. Thus, during operations, the valve member 155 of vent 152 may open or close based on a pressure within the enclosure 112. Thus, in some embodiments, the controller 300 may not be connected to the vent 152 of the vent hood 100.

Figure 12:
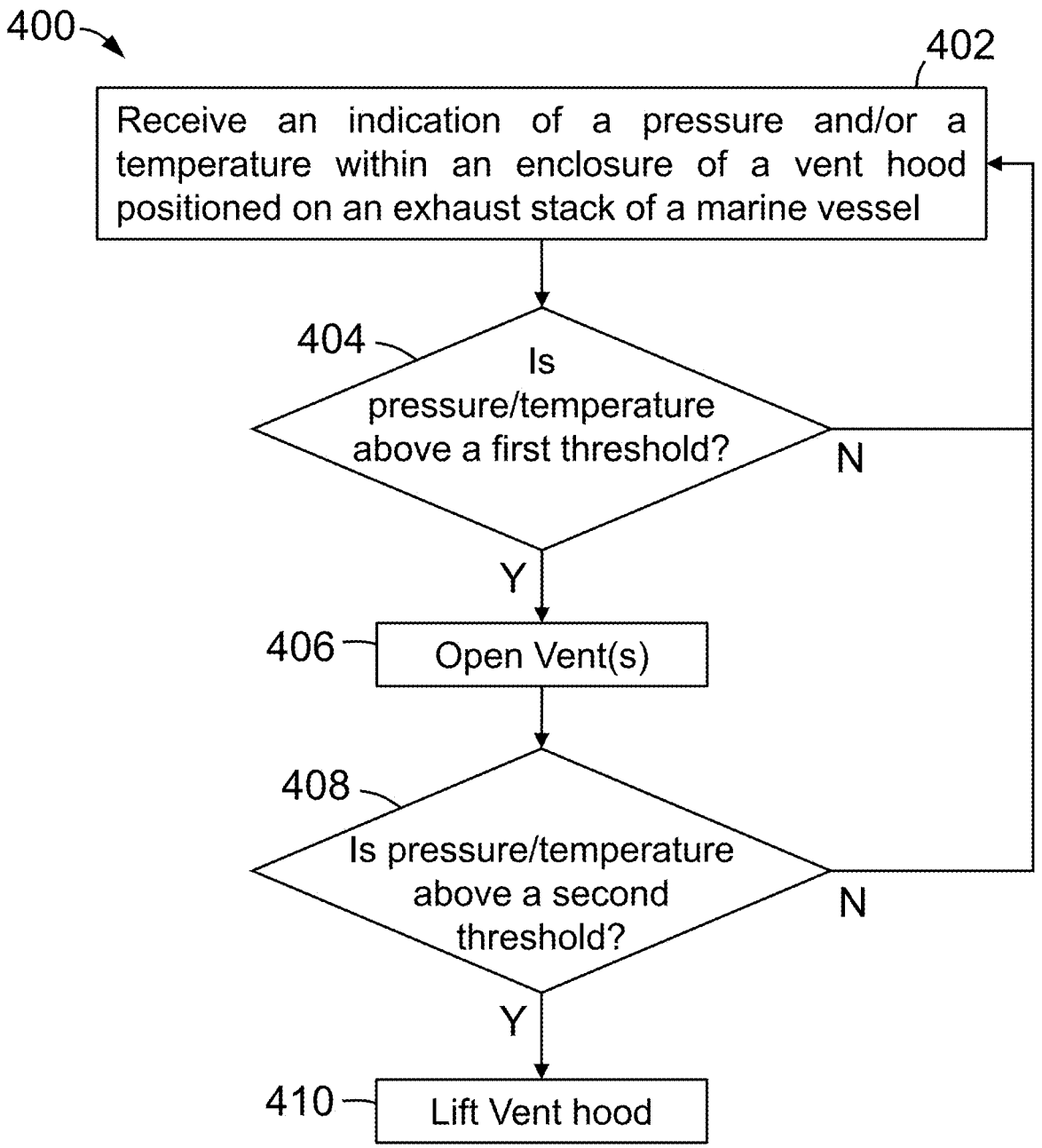
FIG. 12 is a diagram of a method for flowing the exhaust of a marine vessel through a vent hood according to some embodiments of the disclosure.

Reference is now made to FIG. 12, in which a method 400 for flowing the exhaust of a marine vessel through a vent hood (for instance, vent hood 100) is shown according to some embodiments. In some embodiments, the method 400 may be performed (for instance, wholly or partially) by the processor of a controller (such as processor 302 of controller 300 shown in FIG. 11). Thus, the method 400 may be representative of the machine-readable instructions 306 stored on memory 304, or some of the machine-readable instructions 306 for some embodiments of controller 300 (FIG. 11). In addition, in describing the features of method 400, continuing reference will be made to the features of the embodiments shown in FIGS. 1-11 and previously described. In some embodiments, the method 400 may be performed in parallel (for instance, by processor 302) with other methods or processes, and/or may be combined or integrated with other methods or processes.

The method 400 may initially include receiving an indication of a pressure and/or temperature within an enclosure of a vent hood (for instance, vent hood 100) positioned on an exhaust stack of a marine vessel at block 402. For instance, as shown in FIG. 11 and previously described, the controller 300 may receive an indication of a pressure and temperature within the enclosure 112 of the housing 113 of vent hood 100 via outputs from the pressure sensor 310 and temperature sensor 312, respectively.

Next, method 400 includes determining whether the pressure or temperature (such as the pressure or temperature within the enclosure 112) is above a first threshold at block 404. For instance, block 404 may include determining whether either or both of the pressure and the temperature within the enclosure (for instance, enclosure 112) is above a corresponding threshold. The thresholds for the pressure and temperature may be determined based upon an operating pressure and temperature, respectively, of the enclosure (for instance, enclosure 112).

If it is determined that a pressure or a temperature within the enclosure is above a threshold (the determination at block 404 is "Yes" or "Y"), method 400 may proceed to open one or more vents to vent exhaust from the enclosure to the atmosphere and thereby increase a flow rate of exhaust out of the enclosure at block 406. For instance, as shown in FIG. 11 and previously described, if the controller 300 determines that the pressure and/or temperature within the enclosure 112 is above a threshold, the controller 300 may open the vent 152 so as to flow the exhaust out of the enclosure 112 to the surrounding atmosphere 75 in an effort to reduce the pressure and/or temperature, respectively, below the threshold. Conversely, if it is determined that the pressure or the temperature within the enclosure is not above a threshold (the determination at block 404 is "No" or "N"), method 400 may repeat block 402 and continue monitoring the pressure and/or temperature within the enclosure.

If the vent(s) (for instance, vent 152) are open via block 406, method 400 may proceed to determine whether the pressure or temperature within the enclosure is above a second threshold at block 408. The second threshold at block 458 may be different from the first threshold in block 404. In some embodiments, the second threshold at block 408 may be higher than the first threshold at block 404. If it is determined that the pressure or temperature is above the second threshold at block 408 (the determination at block 408 is "Yes" or "Y"), method 400 may proceed to lift the vent hood off of the exhaust stack of the marine vessel at block 410. For instance, referring again to FIG. 11, if a temperature and/or a pressure within the enclosure continues to rise after opening the vent 152, it may be determined (for instance, by controller 300) that the vent hood 100 should be lifted off of the exhaust stack (for instance, exhaust stack 50) to avoid operating the vent hood 100 outside of a desired pressure and/or temperature range. In some embodiments, the controller 300 may be connected to the crane 254 (FIGS.

2 and 6-8) and may actuate the crane 254 to lift the vent hood 100 from the exhaust stack 50 at block 410. In some embodiments, the controller 300 may output an alarm or other alert (for instance, visual, audible, tactile, or some combination thereof) to personnel (for instance, via the user interface 308) indicating that the vent hood 100 should be lifted from the exhaust stack 50 so as to thereby trigger personnel or another controller to take suitable action (for instance, by lifting the vent hood 100 via crane 254 as previously described).

Conversely, if it is determined that the pressure or temperature within the enclosure is not below the second threshold at block 408 (the determination at block 408 is "No" or "N"), method 400 may repeat block 402 and continue monitoring the pressure and/or temperature within the enclosure As previously described, one or more sides of the lower portion 103 of vent hood 100 may be radially extended or retracted to adjust the size of the opening 102 (FIGS. 3 and 4). The embodiment of the vent hood 100 shown in FIGS. 3 and 4 includes one planar side surface 109 on the lower portion 103 (e.g., the second surface 109) that diverges radially away from the central axis 105. However, it should be appreciated that other embodiments of vent hood 100 may include more than one of the sides on the lower portion 103 (such as all of the sides or less than all of the sides of the lower portion 103) that diverge radially away from the central axis 105.

Figure 13:
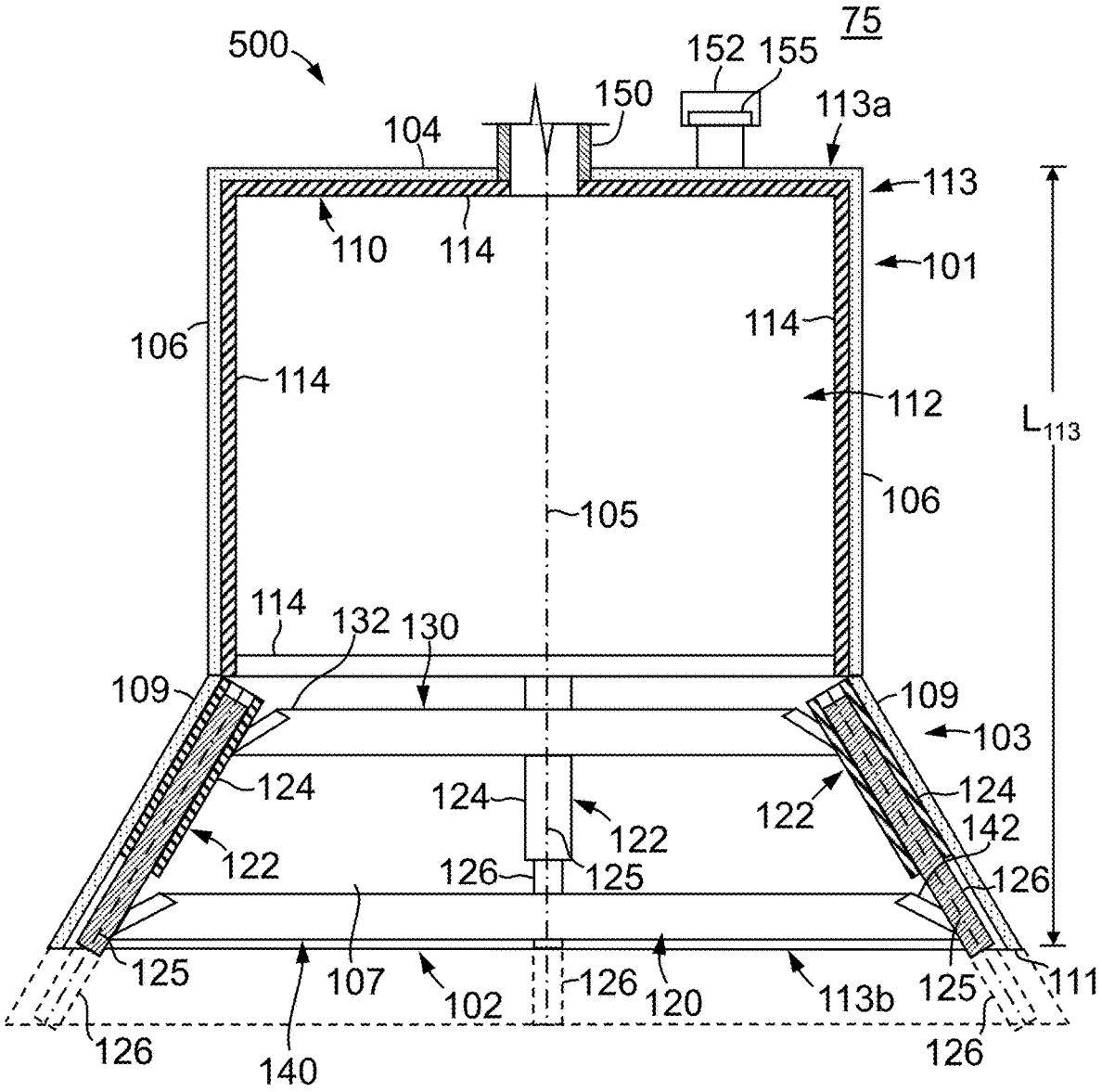
FIG. 13 is a cross-sectional view of an embodiment of the vent hood of FIG. 1 according to some embodiments of the disclosure.

For instance, FIG. 13 shows an embodiment of a vent hood 500 that may be used in place of the vent hood 100 in some embodiments. The vent hood 500 may be similar to the vent hood 100 in a number of ways. Thus, components of the vent hood 500 that are shared with the vent hood 100 are identified in FIG. 13 with the same reference numerals, and the following description will focus on the features of vent hood 500 that are different from the vent hood 100.

In particular, the vent hood 500 includes a pair of second side surfaces 109 that diverge radially away from the central axis 105 (such as at an acute angle 0 as previously described and shown in FIG. 3). The pair of second side surfaces 109 are positioned radially opposite one another about the central axis 105, and are connected by a pair of first planar side surfaces 107 (one of which is shown in FIG. 13).

During operations, as the lower portion 103 of the vent hood 500 is extended along the central axis 105, the size of the opening 102 may be increased as previously described. In particular, because the lower portion 103 includes the pair of second planar side surface 109 that are oriented at the acute angle θ to the central axis 105 as previously described, as the axial length of the lower portion 103 and the axial length $L_{113}$ of housing 113 increases, a lower ends (or lower edges) 111 of the second side surfaces 109 (which may be positioned at the lower end 113*b* of housing 113) may move or diverge radially outward or away from the central axis 105 so that the opening 102 (particularly the surface area of opening 102 in a radially oriented plane through the central axis 105) is increased. The dotted lines in FIG. 13 illustrate the increased size of the opening 102 upon increasing the axial length $L_{113}$ of housing 113 according to some embodiments. Conversely, as the axial length of the lower portion 103 and the axial length $L_{113}$ of housing 113 decreases, the lower ends (or lower edges) 111 of the second side surfaces 109 may converge radially inward toward the central axis 105 so that the opening 102 (particularly the surface area of opening 102 in a radially oriented plane through the central axis 105) is decreased.

In some embodiments, all of the sides of the lower portion 103 may be configured as second planar side surfaces 109 that diverge radially away from the central axis 105 (such as at an acute angle θ as previously described and shown in FIG. 3). Thus, as the lower portion 103 is extended, all of the sides of the lower portion 103 may diverge radially away from the central axis 105 to thereby increase the size of the opening 102 as previously described.

As explained above and reiterated below, this disclosure includes, without limitation, the following example embodiments.

Example Embodiment 1: a vent hood for collecting exhaust from a marine vessel, the vent hood comprising: a housing including: an upper end, a lower end spaced from the upper end along a central axis of the housing, and an opening positioned at the lower end configured to receive an exhaust stack of the marine vessel therethrough; and an engagement adjustment assembly connected to the housing that is configured to increase a length of the housing between the upper end and the lower end to thereby increase a size of the opening.

Example Embodiment 2: the vent hood of any of the example embodiments, wherein the housing further includes: an upper portion extending from the upper end; and a lower portion extending from the upper portion to the lower end, wherein the engagement adjustment assembly is connected to the lower portion, and wherein the lower portion includes a side surface that is oriented at an acute angle to the central axis such that the engagement adjustment assembly is configured to increase a length of the side surface to diverge a lower edge of the side surface radially away from the central axis.

Example Embodiment 3: the vent hood of any of the example embodiments, wherein the engagement adjustment assembly includes an extendable frame member connected to the side surface, and wherein a length of the extendable frame member is adjustable to adjust the length of the side surface.

Example Embodiment 4: the vent hood of any of the example embodiments, wherein the engagement adjustment assembly includes a plurality of extendable frame members positioned about a perimeter of the housing, wherein each of the extendable frame members is configured to be extended to increase the length of the vent hood along the central axis to thereby increase the size of the opening.

Example Embodiment 5: the vent hood of any of the example embodiments, wherein each of the plurality of extendable frame members includes: an outer sheath; and an inner member coaxially nested within the outer sheath, wherein the inner member is configured to extend out of and retract into the outer sheath.

Example Embodiment 6: the vent hood of any of the example embodiments, wherein at least one of the plurality of extendable frame members is configured as an extendable piston-cylinder assembly.

Example Embodiment 7: the vent hood of any of the example embodiments, wherein the housing includes an outer covering, the outer covering defining the opening, wherein the inner member of each of the plurality of extendable frame members is connected to the outer covering.

Example Embodiment 8: the vent hood of any of the example embodiments, wherein the outer covering includes a fabric.

Example Embodiment 9: The vent hood of any of the example embodiments, further comprising a relief vent positioned at the upper end, the relief vent includes a valve member that is configured to open to allow the exhaust to escape the vent hood via the relief vent.

Example Embodiment 10: the vent hood of any of the example embodiments, wherein the relief vent is a pressure-actuated vent.

Example Embodiment 11: the vent hood of any of the example embodiments, wherein the valve member of the relief vent is configured to be opened and closed by a controller.

Example Embodiment 12: the vent hood of any of the example embodiments, further comprising one or more seals configured to engage with an outer surface of the exhaust stack of the marine vessel to prevent exhaust from flowing out of the vent hood via the opening.

Example Embodiment 13: an exhaust collection system for collecting exhaust from a marine vessel, the exhaust collection system comprising: an exhaust cleaning assembly including a tank; and a vent hood in fluid communication with the tank of the exhaust cleaning assembly, the vent hood including: a frame including one or more extendable frame members, and an outer covering that covers the frame to define an enclosure with an opening configured to receive an exhaust stack of the marine vessel therethrough, the one or more extendable frame members to extend and retract to adjust a size of the opening.

Example Embodiment 14: the exhaust collection system of any of the example embodiments, wherein each of the one or more extendable frame members are configured to extend to increase a size of the opening and to retract to decrease a size of the opening.

Example Embodiment 15: the exhaust collection system of any of the example embodiments, wherein each of the one or more extendable frame members are configured to extend to increase a length of the vent hood.

Example Embodiment 16: the exhaust collection system of any of the example embodiments, wherein each of the one or more extendable frame members includes: an outer sheath; and an inner member coaxially nested within the outer sheath, wherein the inner member is configured to extend out of and retract into the outer sheath.

Example Embodiment 17: the exhaust collection system of any of the example embodiments, wherein at least one of the one or more extendable frame members is configured as an extendable piston-cylinder assembly.

Example Embodiment 18: the exhaust collection system of any of the example embodiments, wherein the vent hood is in fluid communication with the tank of the exhaust cleaning assembly with a flexible conduit.

Example Embodiment 19: the exhaust collection system of any of the example embodiments, further comprising: a relief vent fluidly connected to the enclosure; a sensor configured to detect a pressure or temperature within the enclosure; and a controller connected to the relief vent and the sensor, the controller configured to: receive an indication of the pressure or temperature within the enclosure via the sensor; and open the relief vent based on the pressure or temperature within the enclosure.

Example Embodiment 20: the exhaust collection system of any of the example embodiments, wherein the controller is configured to: determine that the pressure or temperature within the enclosure is above a first threshold; open the relief vent based on the determination that the pressure or temperature within the enclosure is above the first threshold; determine that the pressure or temperature within the enclosure is above a second threshold, the second threshold being higher than the first threshold; and cause a crane to lift the vent hood from the exhaust stack of the marine vessel.

Example Embodiment 21: the exhaust collection system of any of the example embodiments, wherein the outer covering includes a fabric.

Example Embodiment 22: the exhaust collection system of any of the example embodiments, further comprising a relief vent fluidly connected to the enclosure and configured to selectively open to allow the exhaust to flow out of the vent hood via the relief vent.

Example Embodiment 23: the exhaust collection system of any of the example embodiments, wherein the vent hood includes one or more seals configured to engage with an outer surface of the exhaust stack of the marine vessel to prevent exhaust from flowing out of the vent hood via the opening.

Example Embodiment 24: a vent hood for collecting exhaust from a marine vessel, the vent hood comprising: a housing defining an enclosure, the housing including an opening into the enclosure; an engagement adjustment assembly configured to adjust a size of the opening; and a seal configured to engage with an outer surface of an exhaust stack of the marine vessel when the housing is lowered onto the exhaust stack, the seal being positioned at least partially within the enclosure and connected to the engagement adjustment assembly such that the seal surrounds the opening and expands and contracts as the engagement adjustment assembly adjusts the size of the opening.

Example Embodiment 25: the vent hood of any of the example embodiments, wherein the engagement adjustment assembly is configured to increase a length of the housing to thereby increase the size of the opening.

Example Embodiment 26: the vent hood of any of the example embodiments, wherein the housing further comprises: a central axis, an upper end, and a lower end spaced from the upper end along the central axis, wherein the opening is positioned at the lower end; and a side surface that is oriented at an acute angle to the central axis such that the engagement adjustment assembly is configured to increase a length of the side surface to diverge a lower edge of the side surface radially away from the central axis and thereby increase the size of the opening.

Example Embodiment 27: the vent hood of any of the example embodiments, wherein the engagement adjustment assembly includes one or more extendable frame members, each including: an outer sheath; and an inner member coaxially nested within the outer sheath, wherein the inner member is configured to extend out of and retract into the outer sheath.

Example Embodiment 28: the vent hood of any of the example embodiments, wherein at least one of the one or more extendable frame members is configured as an extendable piston-cylinder assembly.

Example Embodiment 29: the vent hood of any of the example embodiments, further comprising a relief vent fluidly connected to the enclosure and configured to selectively open to allow the exhaust to flow out of the vent hood via the relief vent.

Example Embodiment 30: the vent hood of any of the example embodiments, wherein the seal comprises a baffle plate.

Example Embodiment 31: the vent hood of any of the example embodiments, wherein the seal comprises a compliant seal.

Example Embodiment 32: the vent hood of any of the example embodiments, wherein the housing includes an outer covering that defines the enclosure.

Example Embodiment 33: the vent hood of any of the example embodiments, wherein the outer covering includes a fabric.

Example Embodiment 34: a method of collecting exhaust from a marine vessel, the method comprising: (a) lowering a vent hood over an exhaust stack of the marine vessel, the vent hood including a housing having an upper end, a lower end spaced from the upper end along a central axis, and an opening positioned at the lower end; (b) adjusting a length of the housing along the central axis to thereby adjust a size of the opening; (c) receiving the exhaust stack at least partially within the housing via the opening; and (d) receiving the exhaust emitted from the exhaust stack into the housing.

Example Embodiment 35: the method of any of the example embodiments, wherein (b) comprises increasing the length of the housing along the central axis to increase a size of the opening.

Example Embodiment 36: the method of any of the example embodiments, wherein (b) comprises increasing a length of one or more extendable frame members positioned at least partially within the housing.

Example Embodiment 37: the method of any of the example embodiments, wherein each of the one or more extendable frame members includes: an outer sheath; and an inner member coaxially nested within the outer sheath, wherein the inner member is configured to extend out of and retract into the outer sheath.

Example Embodiment 38: the method of any of the example embodiments, wherein (b) comprises, for at least one of the one or more extendable frame members, flowing a fluid into the sheath to extend the inner member out of the sheath.

Example Embodiment 39: the method of any of the example embodiments, wherein the housing includes a side surface that is oriented at an acute angle to the central axis, and wherein (b) comprises increasing a length of the side surface to move a lower edge of the side surface radially away from the central axis.

Example Embodiment 40: the method of any of the example embodiments, further comprising: (e) engaging an outer surface of the exhaust stack with a seal that is positioned at least partially within the housing; and (f) preventing exhaust from flowing out of the housing via the opening with the seal.

Example Embodiment 41: the method of any of the example embodiments, further comprising: (g) receiving an indication of a pressure or temperature within the housing; and (h) opening a relief vent connected to the housing to flow exhaust out of the vent hood to an atmosphere surrounding the vent hood based on (g).

Example Embodiment 42: the method of any of the example embodiments, further comprising: (i) determining that the pressure or temperature within the housing is above a first threshold, wherein (h) comprises opening the relief vent based on (g) and (i); (j) determining that the pressure or temperature within the housing is above a second threshold, the second threshold being higher than the first threshold; and (k) lifting the vent hood off of the exhaust stack of the marine vessel based on (j).

Example Embodiment 43: the method of any of the example embodiments, further comprising: (1) flowing exhaust out of the housing via a relief vent; (m) reducing a pressure within the housing as a result of (1); and (n) closing the relief vent after (1) and (m).

Example Embodiment 44: a method of collecting exhaust from a marine vessel, the method comprising: (a) lowering a vent hood over an exhaust stack of the marine vessel, the vent hood including a housing having a frame and an outer cover that covers the frame to define an enclosure, the frame including one or more extendable frame members, and the enclosure having an opening; (b) adjusting a length of the one or more extendable frame members to adjust a size of the opening; (c) inserting the exhaust stack into the opening; and (d) receiving the exhaust emitted from the exhaust stack into the enclosure.

Example Embodiment 45: the method of any of the example embodiments, wherein each of the one or more extendable frame members includes: an outer sheath; and an inner member coaxially nested within the outer sheath, wherein the inner member is configured to extend out of and retract into the outer sheath.

Example Embodiment 46: the method of any of the example embodiments, wherein (b) comprises, for at least one of the one or more extendable frame members, flowing a fluid into the sheath to extend the inner member out of or retract the inner member into the sheath.

Example Embodiment 47: the method of any of the example embodiments, wherein the housing includes a side surface that is oriented at an acute angle to a vertical axis of the housing, and wherein (b) comprises increasing a length of the side surface to move a lower edge of the side surface radially away from the vertical axis.

Example Embodiment 48: the method of any of the example embodiments, further comprising: (c) engaging an outer surface of the exhaust stack with a seal that is at least partially positioned within the enclosure; and (f) preventing exhaust from flowing out of the enclosure via the opening with the seal.

Example Embodiment 49: the method of any of the example embodiments, further comprising: (g) flowing exhaust out of the enclosure via a relief vent; (h) reducing a pressure within the enclosure as a result of (g); and (i) closing the relief vent after (g) and (h).

Example Embodiment 50: the method of any of the example embodiments, further comprising: (j) receiving an indication of a pressure or temperature within the enclosure; (k) determining that the pressure or temperature within the enclosure is above a first threshold; (1) opening a relief valve connected to the enclosure to flow exhaust out of the enclosure to an atmosphere surrounding the housing based on (k); (m) determining that the pressure or temperature within the enclosure is above a second threshold, the second threshold being higher than the first threshold; and (n) lifting the vent hood off of the exhaust stack of the marine vessel based on (m).

Example Embodiment 51: a method of collecting exhaust from a marine vessel, the method comprising: (a) lowering a vent hood over an exhaust stack of the marine vessel, the vent hood including: a housing defining an enclosure and having an opening into the enclosure, an engagement adjustment assembly, and a seal positioned at least partially within the enclosure; (b) expanding or contracting a size of the opening with the engagement adjustment assembly; (c) expanding or contracting the seal with the opening during (b); and (d) engaging the seal with an outer surface of the exhaust stack to prevent exhaust from flowing out of the enclosure via the opening.

Example Embodiment 52: the method of any of the example embodiments, wherein (b) comprises adjusting a length of the housing.

Example Embodiment 53: the method of any of the example embodiments, wherein (b) increasing the length of the housing to expand the size of the opening.

Example Embodiment 54: the method of any of the example embodiments, wherein (b) comprises increasing a length of one or more extendable frame members of the vent hood.

Example Embodiment 55: the method of any of the example embodiments, wherein each of the one or more extendable frame members includes: an outer sheath; and an inner member coaxially nested within the outer sheath, wherein the inner member is configured to extend out of and retract into the outer sheath.

Example Embodiment 56: the method of any of the example embodiments, wherein (b) comprises, for at least one of the one or more extendable frame members, flowing a fluid into the sheath to extend the inner member out of the sheath.

Example Embodiment 57: the method of any of the example embodiments, wherein the housing includes a side surface that is oriented at an acute angle to a vertical axis of the housing, and wherein (b) comprises increasing a length of the side surface to move a lower edge of the side surface radially away from the vertical axis of the housing.

Example Embodiment 58: the method of any of the example embodiments, further comprising: (c) flowing exhaust out of the enclosure via a relief vent; (f) reducing a pressure within the enclosure as a result of (e); and (g) closing the relief vent after (c) and (f).

Example Embodiment 59: the method of any of the example embodiments, further comprising: (h) receiving an indication of a pressure or temperature within the enclosure; (i) determining that the pressure or temperature within the enclosure is above a first threshold; (j) opening a relief and connected to the housing to flow exhaust out of the enclosure to an atmosphere surrounding the housing based on (i); (k) determining that the pressure or temperature within the enclosure is above a second threshold, the second threshold being higher than the first threshold; and (l) lifting the vent hood off of the exhaust stack of the marine vessel based on (k).

As described above, the embodiments disclosed herein include vent hoods that may collect exhaust emitted from a marine vessel when the marine vessel is positioned at a berthing location. In some embodiments, the collected exhaust may be routed to an exhaust cleaning assembly that may store and/or process the exhaust to prevent harmful chemicals or pollutants within the exhaust from being emitted to the atmosphere. In some embodiments, the vent hoods of the embodiments disclosed herein may be adjustable to engage with exhaust stacks of multiple sizes and/or shapes.

Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to " Also, the terms "couple," "couples, "connect," or "connects" are intended to mean either an indirect or direct connection. Thus, if a first device couples or connects to a second device, that connection may be through a direct connection of the two devices, or through an indirect connection that is established via other devices, components, nodes, and connections. In addition, as used herein, the terms "axial" and "axially" generally mean along or parallel to a given axis (such as a central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

This application is a continuation of U.S. Non-Provisional application Ser. No. 18/369,514, filed Sep. 18, 2023, titled "EXHAUST VENT HOODS FOR MARINE VESSELS AND RELATED METHODS," which claims priority to and the benefit of U.S. Provisional Application No. 63/485,887, filed Feb. 18, 2023, and entitled "Exhaust Vent Hoods for Marine Vessels and Related Methods," and U.S. provisional application Ser. No. 63/521,380, filed Jun. 16, 2023, and entitled "Exhaust Vent Hoods for Marine Vessels and Related Methods," the contents of which are incorporated herein by reference in their entirety.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An exhaust collection system to collect exhaust from a marine vessel, the exhaust collection system comprising:

an exhaust cleaning assembly including a tank; and a vent hood in fluid communication with the tank of the exhaust cleaning assembly, the vent hood including one or more extendable frame member, and an outer covering positioned to cover at least portions of the one or more extendable frame member so as to define an enclosure with an opening configured to receive an exhaust stack of the marine vessel therethrough, the one or more extendable frame members to extend and retract to adjust a size of the opening.

2. The exhaust collection system of claim 1, wherein the outer covering defines a housing of the vent hood, wherein the housing has an upper end and a lower end spaced from the upper end along a central axis, and wherein the housing further includes one or more side surfaces that are oriented at a selected angle to the central axis such that the extension of the one or more extendable frame member is configured to increase a length of the one or more side surfaces to diverge a lower edge of the one or more side surfaces radially away from the central axis.

3. The exhaust collection system of claim 1, wherein the one or more extendable frame member is configured to extend to increase a size of the opening and to retract to decrease a size of the opening.

4. The exhaust collection system of claim 3, wherein the one or more extendable frame member is configured to extend to increase a length of the vent hood.

5. The exhaust collection system of claim 3, wherein the one or more extendable frame members includes an outer sheath and an inner member coaxially nested within the outer sheath, and wherein the inner member is configured to extend out of and retract into the outer sheath.

6. The exhaust collection system of claim 5, wherein the inner member of the one or more extendable frame members is connected to the outer covering.

7. The exhaust collection system of claim 5, wherein the one or more extendable frame members is configured as an extendable piston-cylinder assembly.

8. The exhaust collection system of claim 1, further comprising:

a relief vent fluidly connected to the enclosure;

a sensor configured to detect one or more of a pressure or a temperature within the enclosure; and a controller connected to the relief vent and the sensor, the controller configured to:

receive an indication of the pressure or temperature within the enclosure via the sensor, and open the relief vent based on one or more of: the pressure or the temperature within the enclosure.

9. The exhaust collection system of claim 8, wherein the controller is configured to:

determine when the pressure or the temperature within the enclosure is above a first threshold, open the relief vent based on the determination when the pressure or the temperature within the enclosure is above the first threshold, determine that the pressure or the temperature within the enclosure is above a second threshold, the second threshold being higher than the first threshold, and cause a crane to lift the vent hood from the exhaust stack of the marine vessel.

10. The exhaust collection system of claim 1, further comprising a relief vent fluidly connected to the enclosure and configured to selectively open to allow the exhaust to flow out of the vent hood via the relief vent.

11. The exhaust collection system of claim 1, wherein the vent hood includes one or more seals configured to engage with an outer surface of the exhaust stack of the marine vessel to prevent exhaust from flowing out of the vent hood via the opening.

12. A vent hood to collect exhaust from a marine vessel, the vent hood comprising:

a housing defining an enclosure, the housing including an opening positioned to extend into the enclosure;

an engagement adjustment assembly positioned to adjust a size of the opening; and a seal positioned to contact an outer surface of an exhaust stack of the marine vessel when the housing is lowered onto the exhaust stack, the seal positioned at least partially within the enclosure and connected to the engagement adjustment assembly so that the seal expands and contracts as the engagement adjustment assembly adjusts the size of the opening.

13. The vent hood of claim 12, wherein the engagement adjustment assembly is configured to increase a length of the housing, thereby to increase the size of the opening.

14. The vent hood of claim 13, wherein the housing further comprises:

a central axis, an upper end, and a lower end spaced from the upper end along the central axis so that the opening is positioned at the lower end, and a side surface that is oriented at an acute angle to the central axis such that the engagement adjustment assembly is configured to increase a length of the side surface to diverge a lower edge of the side surface radially away from the central axis, thereby to increase the size of the opening.

15. The vent hood of claim 13, wherein the engagement adjustment assembly includes one or more extendable frame members, each including:

an outer sheath, and an inner member coaxially nested within the outer sheath, wherein the inner member is configured to extend out of and retract into the outer sheath, and wherein at least one of the one or more extendable frame members is configured as an extendable piston-cylinder assembly.

16. The vent hood of claim 15, further comprising a relief vent fluidly connected to the enclosure and configured to open, thereby to allow the exhaust to flow out of the vent hood via the relief vent.

17. The vent hood of claim 12, wherein the seal comprises one or more of a baffle plate or a compliant seal.

18. A method of collecting exhaust from a marine vessel, the method comprising:

(a) positioning a vent hood over an exhaust stack of the marine vessel, the vent hood including (i) a housing to define an enclosure and (II) one or more extendable frame member, and the enclosure having an opening;

(b) adjusting a length of the one or more extendable frame member to adjust a size of the opening;

(c) positioning the exhaust stack into the opening; and (d) receiving exhaust when emitted from the exhaust stack into the enclosure.

19. The method of claim 18, wherein each of the one or more extendable frame member includes an outer sheath and an inner member coaxially nested within the outer sheath, wherein the inner member is configured to extend out of and retract into the outer sheath, and wherein step (b) includes for the one or more extendable frame member, flowing a fluid into the sheath to extend the inner member out of or retract the inner member into the sheath.

20. The method of claim 19, wherein the housing includes one or more side surfaces that are oriented at a selected angle to a vertical axis of the housing, and wherein step (b) further includes increasing a length of the one or more side surfaces to move a lower edge of the one or more side surfaces radially away from the vertical axis.

* * * * *